US008226314B2

(12) United States Patent
Lee

(10) Patent No.: US 8,226,314 B2
(45) Date of Patent: Jul. 24, 2012

(54) PRESS-ACTION DEVICE

(75) Inventor: Vincent K. Lee, Taipei (TW)

(73) Assignee: Benext International Corporation, Chino, CA (US)

( * ) Notice: Subject to any disclaimer, the term of this patent is extended or adjusted under 35 U.S.C. 154(b) by 507 days.

(21) Appl. No.: 12/499,343

(22) Filed: Jul. 8, 2009

(65) Prior Publication Data

US 2010/0098477 A1 Apr. 22, 2010

(30) Foreign Application Priority Data

Mar. 25, 2009 (TW) ..... 98204720 U
May 20, 2009 (TW) ..... 98116796 A

(51) Int. Cl.
*B43K 29/00* (2006.01)

(52) U.S. Cl. ..... 401/195; 401/99; 401/111

(58) Field of Classification Search ..... 401/195, 401/292, 99, 103, 109–111; 446/241
See application file for complete search history.

(56) References Cited

U.S. PATENT DOCUMENTS 2,896,348 A 7/1959 Herne
2,971,283 A 2/1961 Parker
3,343,293 A 9/1967 Kirklen
3,404,891 A * 10/1968 Glass et al. ..... 446/241
3,565,441 A 2/1971 Matsumoto
4,002,335 A 1/1977 Bailey
4,037,845 A 7/1977 Hooker
4,097,048 A 6/1978 Poulsen et al.
4,261,571 A 4/1981 Ito
4,492,379 A 1/1985 Okada
4,666,159 A 5/1987 Sutter
4,801,145 A * 1/1989 Arevalo ..... 401/195
5,054,782 A 10/1991 Sutter
6,386,780 B1 5/2002 Brummernhenrich
6,742,953 B2 6/2004 Burden et al.
2007/0292199 A1 * 12/2007 Waldinger et al. ..... 401/192
2010/0322696 A1 * 12/2010 Liu ..... 401/99

* cited by examiner

*Primary Examiner* — David J Walczak
*Assistant Examiner* — Bradley Oliver
(74) *Attorney, Agent, or Firm* — Alan Kamrath; Kamrath IP Lawfirm, PA

(57) ABSTRACT

A press-action device includes a holding barrel, a push button, a rotation module, and an auxiliary spring. The holding barrel includes a window, and the rotation module includes at least one rotation barrel on which a plurality of patterns can be attached. When a user pushes the push button, the window will randomly display one of the patterns on the rotation barrel.

18 Claims, 25 Drawing Sheets

PRESS-ACTION DEVICE

BACKGROUND OF THE INVENTION

1. Field of the Invention

The present invention relates to a press-action device. More particularly, the present invention relates to an elongated press-action device, such as a writing instrument, a toy, or an ornament/accessory attached to a key-chain, a necklace, a cell phone, etc.

2. Description of the Related Art

A window pen is one type of press pen which has been developed for a very long time. Generally, when a user pushes a button of the window pen, a pattern (such as a text pattern or a graphical pattern) displayed on the window of a holding barrel is changed accordingly. The principle of the window pen is that once the button of the pen is pressed, the cartridge of the window pen rotates slightly. Therefore, a rotation barrel printed with a plurality of patterns (such as text patterns or graphical patterns) is mounted on the cartridge such that when the pen cap is pressed, the rotation barrel is driven to rotate and thus causes the plurality of patterns printed on the rotation barrel to be displayed in turn in a window. Please refer to U.S. Pat. Nos. 2,896,348, 2,971,283, 3,343,293, 6,386,780 and 6,742,953 for more details of the structure of the window pen.

However, in known prior arts, the plurality of patterns are always displayed in turn. After a user is familiar with the sequence of the patterns, the user can easily predict the content of the next pattern to be displayed. As a result, the traditional window pen becomes boring very soon. Therefore, if the plurality of patterns can be randomly displayed in the window, the user will feel much more interested and amused.

Further, a conventional window pen only has one rotation barrel. Therefore, the window can display only one certain pattern of the rotation barrel at one time. If the window pen has a plurality of rotation barrels, such as three rotation barrels, when the pen cap is pressed, these rotation barrels can independently rotate to randomly display different patterns, thus increasing the entertainment value. The most common three-barrel rotation mechanism is a slot machine. Please refer to U.S. Pat. Nos. 3,565,441, 4,002,335, 4,037,845, 4,097,048, 4,261,571, 4,492,379, 4,666,159, and 5,054,782 for more details of the structure of a slot machine. However, in the abovementioned prior art patents, the driving mechanism for the rotation barrel is basically installed in one side of a rotation barrel. It is very difficult to implement the existing mechanism of the slot machine in a window pen, since the interior space of the window pen is very narrow. Further, in order to contain the driving mechanism, the diameter of the rotation barrel has to be half of that of the holding barrel, but such a design would allow only a very small pattern to be printed on the rotation barrel. In the technical field of a conventional window pen, the concept of a plurality of freely-rotating rotation barrels has never been disclosed. Even if someone were to come up with the idea of combining a plurality of rotation barrels with a window pen, he/she would still need to solve the problem of the very small interior space of the holding barrel.

SUMMARY OF THE INVENTION

It is an object of the present invention to provide a press-action device, such as a writing instrument, which can randomly display patterns in a window of the press-action device.

It is another object of the present invention to provide a press-action device, such as a writing instrument, which has at least one rotation barrel capable of performing free rotation.

To achieve the aforementioned objects, it is necessary to invent a press-action device such as a writing instrument which comprises a holding barrel, a push button, a writing element, a pressing module, a rotation module, and a writing element spring. The holding barrel comprises a first end, a second end, and a window. The push button is flexibly disposed to the first end of the holding barrel. The push button allows a user to propel/repel to perform a linear motion. The writing element is installed in the holding barrel, and the writing element has a writing end. When the push button is propelled/repelled, the pressing module drives the writing end of the writing element to protrude from or retract into the second end of the holding barrel.

The rotation module is connected with the push button, and the rotation module comprises a driving part and at least one rotation barrel. The driving part is connected with the push button to drive the rotation barrel to rotate.

By the aforementioned structure, when the user pushes the push button, the push button firstly performs a first stage, and then performs a second stage. When the push button is performing the first stage, the driving part drives a following part, to drive the rotation barrel to rotate. Therefore, the writing end can gradually protrude from the second end of the holding barrel. When the push button is performing the second stage, the driving part departs from the following part, to make the rotation barrel freely rotate according to the inertia of a force generated when the user pushes the push button during the first stage. Therefore, the writing end protrudes from the second end of the holding barrel.

According to one of the preferred embodiments of the present invention, there can be a plurality of rotation barrels. The plurality of rotation barrels can respectively rotate. When each of the rotation barrels stops, the window can randomly display different patterns.

According to one of the preferred embodiments of the present invention, the driving part comprises a rotation shaft receiver and a rotation shaft. The rotation shaft receiver is fixed to the first end of the holding barrel and has a guiding part The rotation shaft is connected with the push button and is flexibly installed in the rotation shaft receiver. The rotation shaft has an external thread which is associated with the guiding part.

According to one of the preferred embodiments of the present invention, the driving part comprises a curved surface and a slice body. The curved surface is slidingly contacted with the push button. The slice body is connected with the curved surface and is limited to being positioned in the holding barrel. The slice body can move along a vertical direction of the holding barrel.

It should be noted that the press-action device does not have to be a writing instrument. The most novel portion of the present invention is the rotation module, which can be installed in a narrow and elongated barrel. Therefore, the press-action device can be a toy, an ornament/accessory attached to a key-chain, a necklace, a cell phone, etc.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
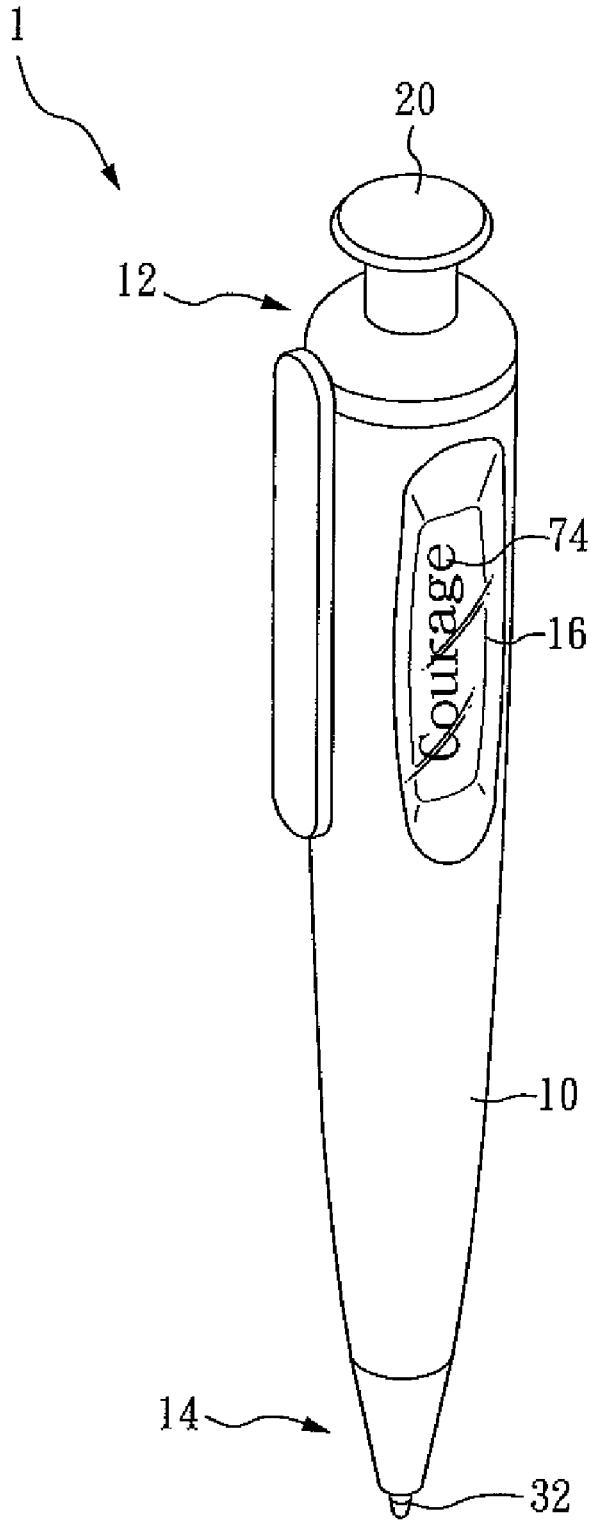
FIG. 1 illustrates a schematic drawing of a press-action writing instrument according to a first embodiment of the present invention.
Figure 2:
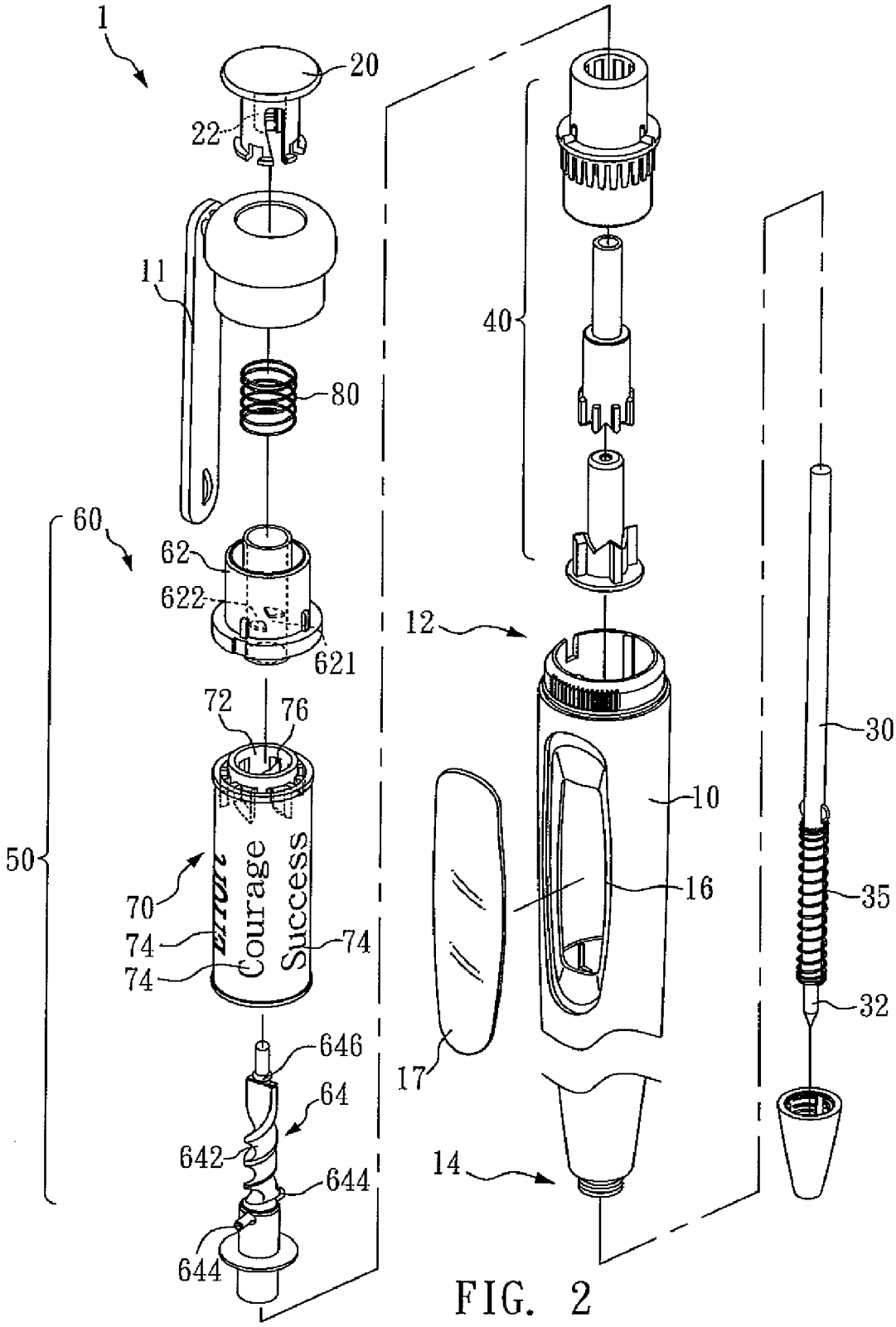
FIG. 2 is an exploded view of the press-action writing instrument according to the first embodiment of the present invention.
Figure 3:
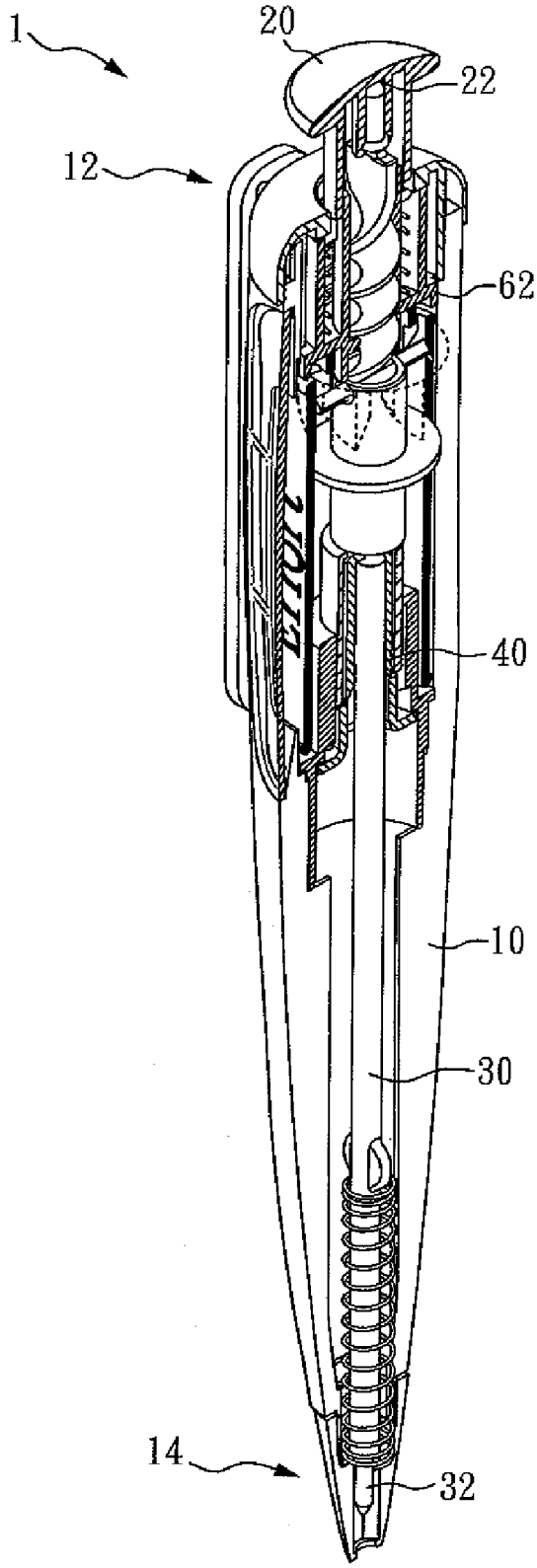
FIG. 3 and FIG. 3A illustrate cross-sectional views of the press-action writing instrument before a push button is pushed, according to the first embodiment of the present invention.

Please refer to FIGS. 1 to 3. A press-action device such as a press-action writing instrument 1 of the present invention comprises a holding barrel 10, a push button 20, a writing element 30, a pressing module 40, a rotation module 50, a writing element spring 35, and an auxiliary spring 80.

The holding barrel 10 comprises a first end 12, a second end 14, and a window 16. The first end 12 and the second end 14 are located at two extreme ends of the holding barrel 10. In this embodiment, the window 16 is a rectangular opening. The holding barrel 10 further comprises a transparent element 17 located corresponding to the window 16 for covering the window 16.

The push button 20 is disposed at the first end 12 of the holding barrel 10, and the writing element 30 is installed in the holding barrel 10. The writing element 30 has a writing end 32. The writing element spring 35 is disposed around the writing element 30. When the push button 20 is propelled/repelled, the pressing module 40 can drive the writing end 32 of the writing element 30 to protrude from or retract into the second end 14 by associating with the writing element spring 35. Because the pressing module 40 of a press pen is a known prior art which can be implemented by various kinds of mechanisms and the structure of the pressing module 40 is not the improved portion of the present invention, there is no need to describe its structure in detail.

The rotation module 50 comprises a driving part 60 and a rotation barrel 70. The object of the driving part 60 is used for driving the rotation barrel 70 to rotate.

The driving part 60 is a driving mechanism having a rotation shaft receiver 62 and a rotation shaft 64. The rotation shaft receiver 62 and a clip 11 are fastened to the first end 12 of the holding barrel 10. The rotation shaft receiver 62 has a through hole 621 and a guiding part 622.

The rotation shaft 64 is installed in the rotation shaft receiver 62 and the rotation barrel 70. The rotation shaft 64 comprises an external thread 642 and a pair of guiding protrusions 644. Furthermore, in order to connect the rotation shaft 64 with the push button 20, one end of the rotation shaft 64 has a positioning protrusion 646, and the inside of the push button 20 has a positioning indentation 22. The sizes and locations of the positioning protrusion 646 and the positioning indentation 22 match with each other, such that the positioning protrusion 646 can be connected with the positioning indentation 22.

One end of an auxiliary spring 80 (such as a spring) is disposed around the rotation shaft receiver 62, while the other end of the auxiliary spring 80 is placed against the push button 20.

The rotation barrel 70 is installed in the holding barrel 10 and is located corresponding to the window 16+The exterior of the rotation barrel 70 can be printed with or attached with different patterns 74 (such as text patterns or graphical patterns). Furthermore, the rotation barrel 70 has a following part 72. In this embodiment, the following part 72 comprises six equidistantly-arranged guiding blocks 76. Please refer to FIG. 2A. Each guiding block 76 is roughly trapezoidal in shape and has a long wall 761, an oblique wall 762 and a short wall 763. A guiding groove 764 is formed between every two adjacent guiding blocks 76.

Please refer to FIGS. 2 to 6 for more details of the four stages of the press-action writing instrument 1 according to a first embodiment of the present invention:

(1) Initial Stage:

Please refer to FIG. 2, FIG. 2A, FIG. 3 and FIG. 3A. During the initial stage, the writing end 32 of the writing element 30 is not yet protruding from the holding barrel 10. At this time, both the push button 20 and the rotation shaft 64 are located at the top, and the guiding protrusion 644 is located at the upper edge of the guiding groove 764.

Figure 2A:
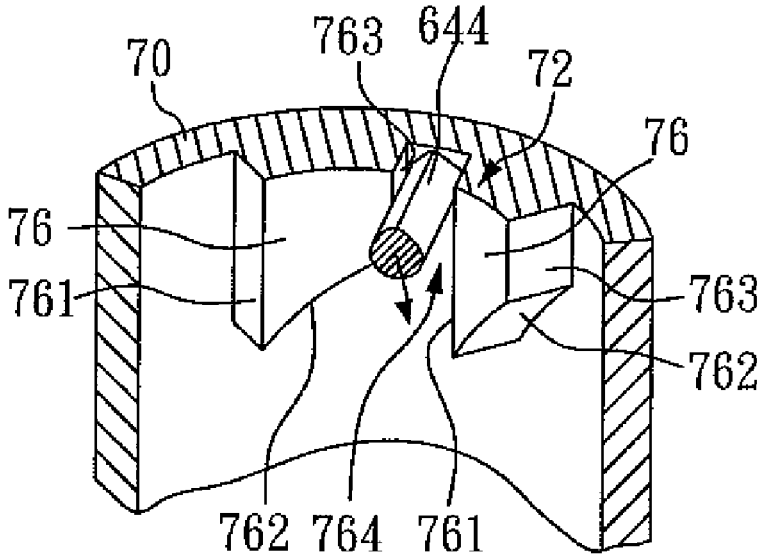
FIGS. 2A to 2D illustrate schematic drawings respectively showing relations among a guiding protrusion of a rotation shaft and guiding blocks of a rotation barrel at different stages according to the first embodiment of the present invention.
Figure 2B:
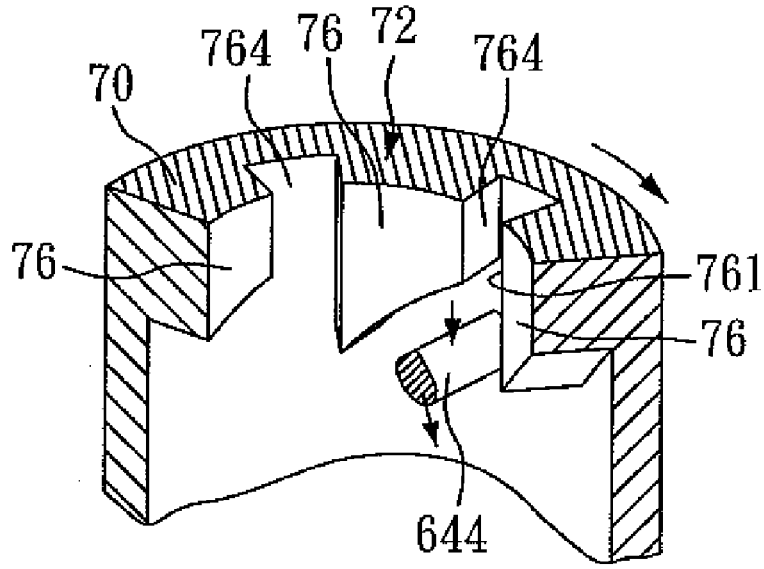
Figure 2C:
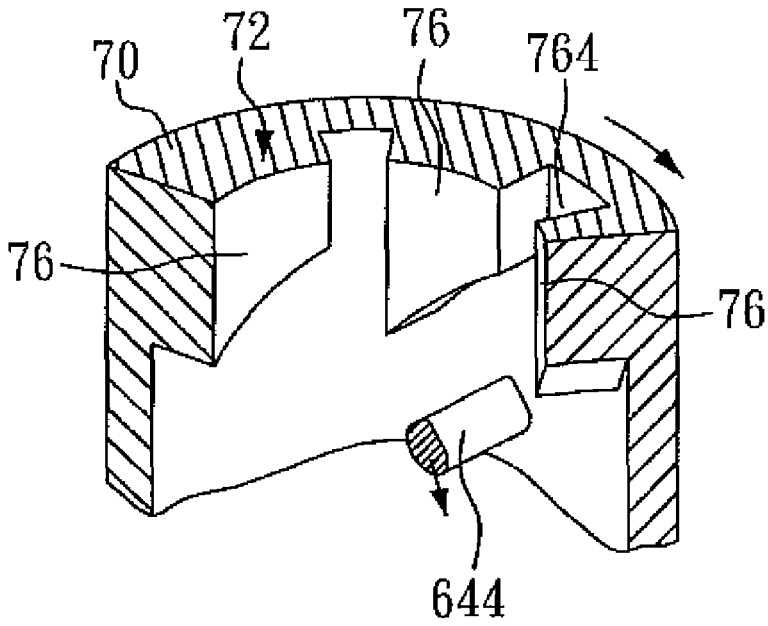
Figure 3B:
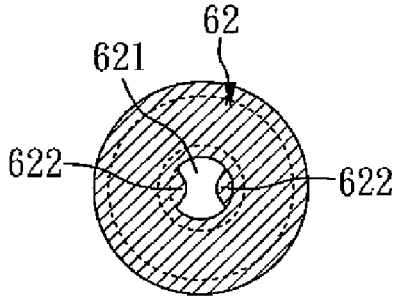
FIG. 3B illustrates a cross-sectional view of a guiding part of a rotation shaft receiver according to the present invention along line B-B of FIG. 3A.
Figure 3A:
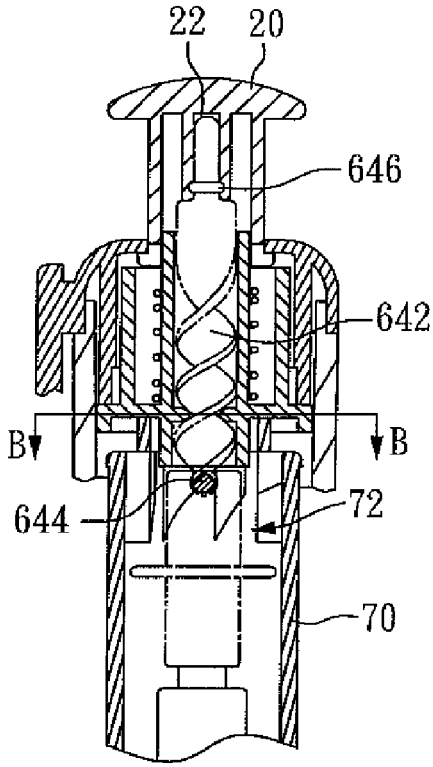
Figure 4:
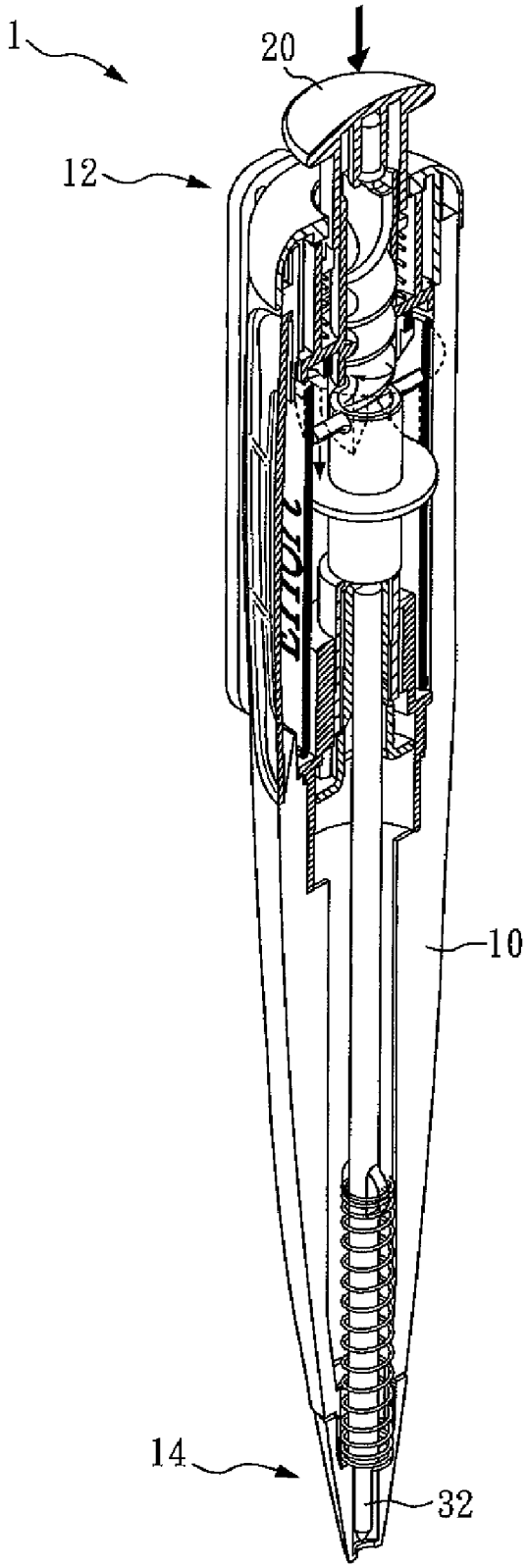
FIG. 4 and FIG. 4A illustrate cross-sectional views of the press-action writing instrument when the push button is performing a first stage, according to the first embodiment of the present invention.
Figure 4A:
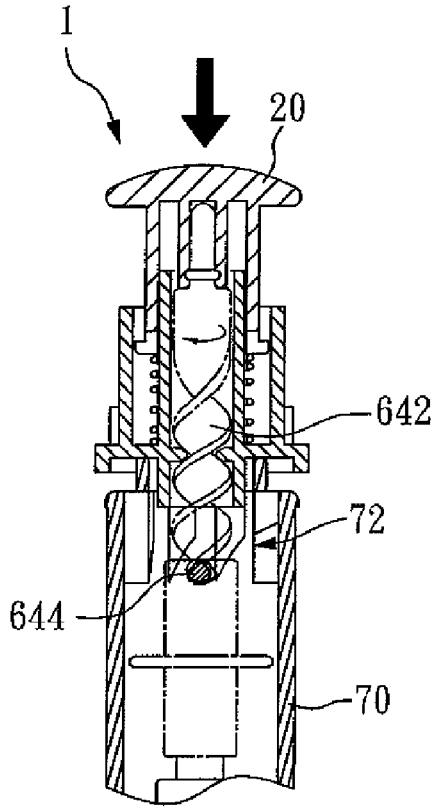

(2) First Stage (Driving Stage):

Please refer to FIG. 2B, FIG. 4, and FIG. 4A regarding a process of driving the rotation barrel 70 to rotate during the first stage. Please refer to FIG. 3B as well. In this embodiment, the guiding part 622 includes two projections located in the center of the through hole 621. Therefore, when a user pushes the push button 20, the rotation shaft 64 will move downwards to pass through the through hole 621, such that the guiding part 622 can drive the rotation shaft 64 to rotate by moving along the external thread 642 (in this embodiment, the rotation shaft 64 performs a clockwise rotation). At this time, the guiding protrusion 644 also moves and rotates downwards, such that the guiding protrusion 644 pushes the long wall 761 of the guiding block 76 to drive the rotation barrel 70 to rotate accordingly. With regard to the guiding protrusion 644, during the first stage, the guiding protrusion 644 moves from the upper edge of the guiding groove 764 (as shown in FIG. 2A) to the lower edge of the guiding groove 764 (as shown in FIG. 2C). Please note that the present invention comprises at least one guiding protrusion 644, or as many guiding protrusions 644 as the guiding grooves 764 (in this embodiment, there are six guiding grooves 764).

Figure 5:
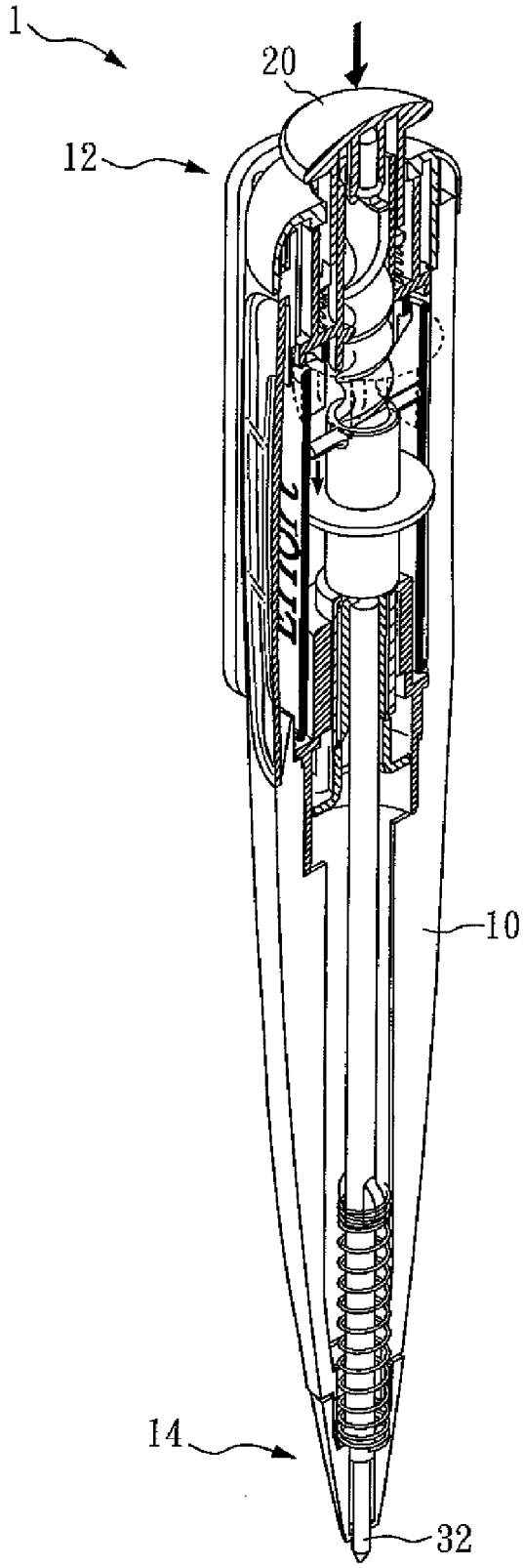
FIG. 5 and FIG. 5A illustrate cross-sectional views of the press-action writing instrument when the push button is performing a second stage, according to the first embodiment of the present invention.
Figure 5A:
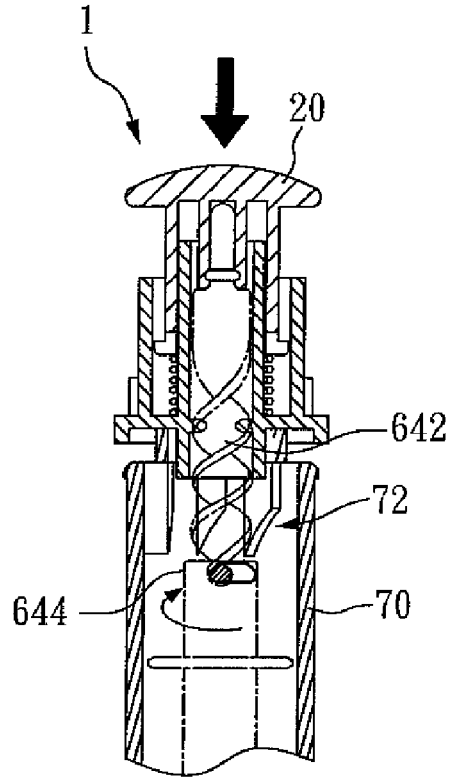

(3) Second Stage (Free Rotation Stage):

Please refer to FIG. 2C, FIG. 5, and FIG. 5A. The second stage is performed right after the first stage. During the second stage, the rotation shaft 64 keeps moving downwards such that the driving part 60 departs from the following part 72, which means that the guiding protrusion 644 departs from the guiding groove 764. Therefore, the guiding protrusion 644 can no longer push the long wall 761 of the guiding block 76, and the guiding protrusion 644 can no longer hold the guiding block 76. As a result, the guiding protrusion 644 is completely departed from the following part 72 such that the rotation barrel 70 can freely rotate.

During the first stage and the second stage, the writing end 32 of the writing element 30 protrudes from the holding barrel 10 (as shown in FIG. 5), because it is pushed downwards by the rotation shaft 64.

Figure 2D:
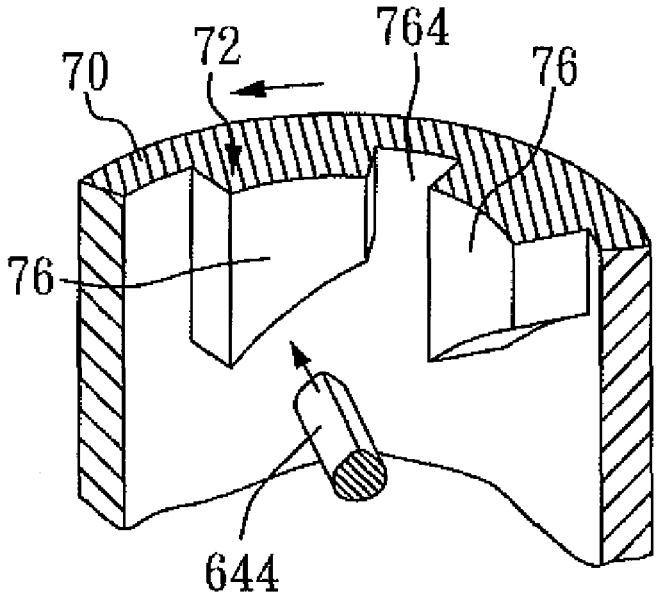
Figure 6:
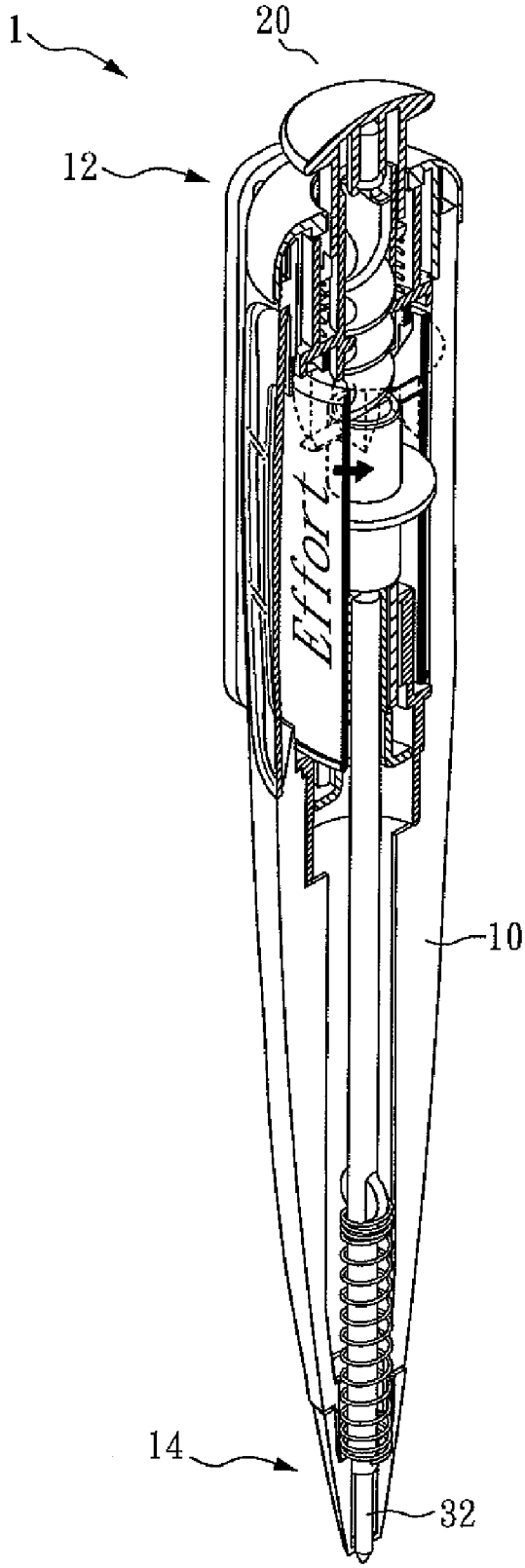
FIG. 6 and FIG. 6A illustrate cross-sectional views of the press-action writing instrument when the push button is performing a third stage, according to the first embodiment of the present invention.
Figure 6A:
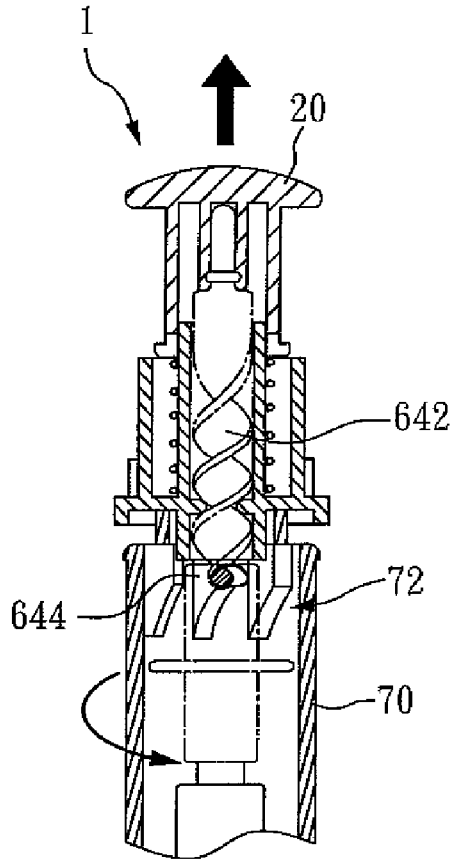
Figure 7:
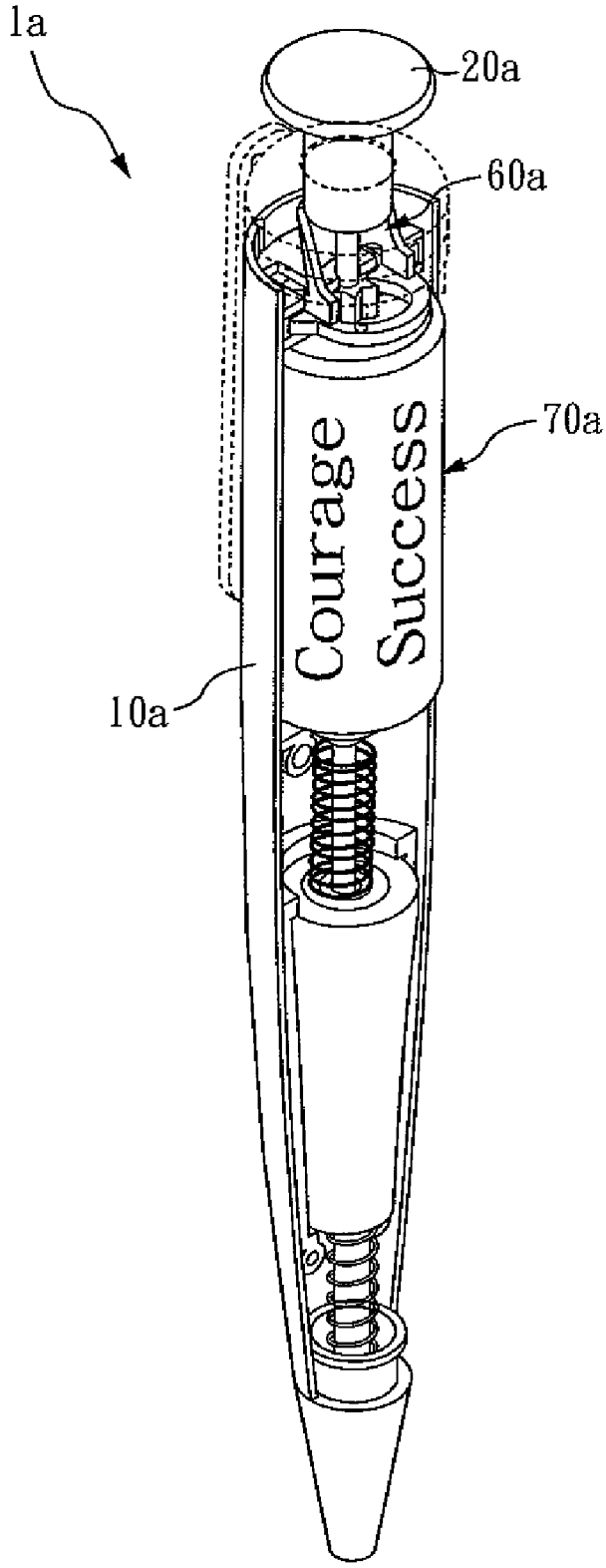
FIG. 7 illustrates a perspective view of the press-action writing instrument according to a second embodiment of the present invention.

(4) Third Stage (Positioning Stage):

Please refer to FIG. 2D, FIG. 6 and FIG. 6A. During the third stage, the user releases the push button 20, such that the rotation shaft 64 can move upwards due to the rebound from the writing element spring 35 and the auxiliary spring 80. Therefore, the guiding protrusion 644 re-enters the guiding groove 764. Please note that because the lower edge of the guiding groove 764 is wide in comparison to the shape of the guiding block 76, the guiding protrusion 644 can easily slide into the guiding groove 764 even when the rotation barrel 70 is still rotating. Finally, the guiding protrusion 644 is returned to the position as shown in FIG. 2A. Similarly, when the rotation shaft 64 moves upwards, the guiding part 622 will drive the rotation shaft 64 to rotate due to the external thread 642 (in this embodiment, the rotation shaft 64 performs a counterclockwise rotation). Because the guiding protrusion 644 finally holds the guiding block 76, the rotation barrel 70 will stop rotating accordingly.

In this embodiment, there are six guiding blocks 76, thereby forming six guiding grooves 764. Therefore, the exterior of the rotation barrel 70 can be printed with or attached with six different patterns 74. According to the aforementioned mechanism, those six different patterns 74 will be randomly displayed in the window 16. Please note further that there are two guiding protrusions 644 in this embodiment. However, the present invention can have as few as one guiding protrusion 644, or have as many as three to six guiding protrusions 644, because there are six guiding grooves 764 in this embodiment. Due to thrust and balance considerations, please note that there should be a plurality of guiding protrusions 644. Each of the included angles between every two guiding protrusions 644 is the same. Furthermore, if there is a plurality of rotation barrels 70 (please refer to a third embodiment of the present invention described later), there will be a plurality of pairs of guiding protrusions 644. Moreover, the number of the guiding blocks 76 can be less or more, but preferably at least three.

The aforementioned first, second and third stages respectively describe statuses of the writing end 32 of the writing element 30 from "non-protruded" to "protruded" from the holding barrel 10. When the user pushes the push button 20 again to change the status of the writing end 32 from "protruded" to "non protruded" from the holding barrel 10, the process will be the same as what happens during the first, second and third stages. Because the auxiliary spring 80 is capable of returning the push button 20 back to its original position (as shown in FIG. 6), it follows that when the user pushes the push button 20 again, the actions of the rotation shaft 64 and the rotation barrel 70 will be the same as the actions in the first stage to the third stage.

Please refer to FIGS. 7 to 10A regarding a press-action device such as a press-action writing instrument 1*a* according to a second embodiment of the present invention. The press-action writing instrument 1*a* comprises a holding barrel 10*a*, a push button 20*a*, a writing element 30*a*, a pressing module 40*a*, a rotation module 50*a*, and a writing element spring 35*a*. The holding barrel 10*a* comprises a first end 12*a*, a second end 14*a*, and a window 16*a*. The major difference between the first embodiment and the second embodiment is the structure of the driving part 60*a* and the following part 72*a*. Further, although the pressing module 40a in the second embodiment is different from the pressing module 40 in the first embodiment, there is no need to describe the structure of the pressing module 40*a* in detail, because the pressing module is a known prior art (i.e., the function of the pressing module in the present invention is to cause the writing end of the writing element to protrude from or retract into the holding barrel).

In this embodiment, the driving part 60*a* comprises a curved surface 66 and a slice body 67. The curved surface 66 is slidingly contacted with the push button 20*a*. The slice body 67 is connected with the curved surface 66. The slice body 67 is limited to being positioned in the holding barrel 10*a*, and the slice body 67 can move along a vertical direction of the holding barrel 10*a*.

The slice body 67 comprises an opening 671 and a protrusion 672. The following part 72*a* is located in the opening 671, and the protrusion 672 can be connected with the following part 72*a*. In this embodiment, the following part 72*a* is a gear with six teeth. Please note that the number of teeth is not limited to the above description.

The slice body 67 further comprises at least one force-receiving part 673. The interior of the holding barrel 10*a* further has a slice body containing groove 18*a* and at least one first auxiliary spring positioning part 19*a*. The slice body containing groove 18*a* is used for containing part of the slice body 67.

In this embodiment, the press-action writing instrument 1*a* further comprises at least one first auxiliary spring 82*a* and a second auxiliary spring 84*a*. The two ends of each first auxiliary spring 82*a* are respectively placed against each force-receiving part 673 and each first auxiliary spring positioning part 19*a*. The first auxiliary spring 82*a* applies force to cause the slice body 67 to return to its original position.

The press-action writing instrument 1*a* further comprises a driving shaft body 90. Two ends of the driving shaft body 90 are respectively connected with the push button 20*a* and the writing element 30*a*. From bottom to top, the driving shaft body 90 sequentially passes through the second auxiliary spring 84*a*, the rotation barrel 70*a*, the following part 72*a* and the driving part 60*a* (as shown in FIG. 8).

Please refer to FIGS. 7 to 10 for more details of the implementation, which is also divided into four stages, of the press-action writing instrument 1*a* according to the second embodiment of the present invention.

Figure 8:
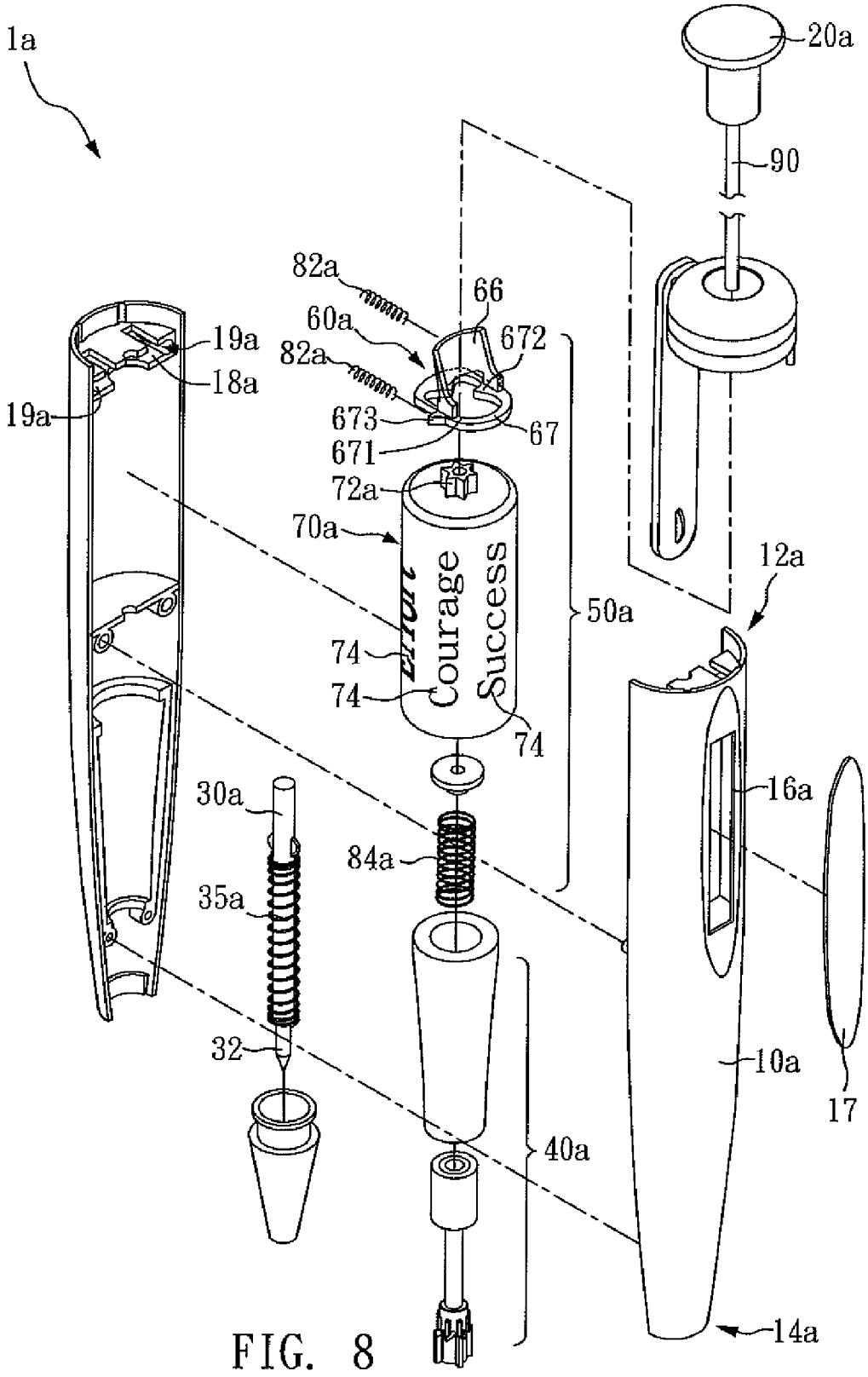
FIG. 8 is an exploded view of the press-action writing instrument according to the second embodiment of the present invention.
Figure 9A:
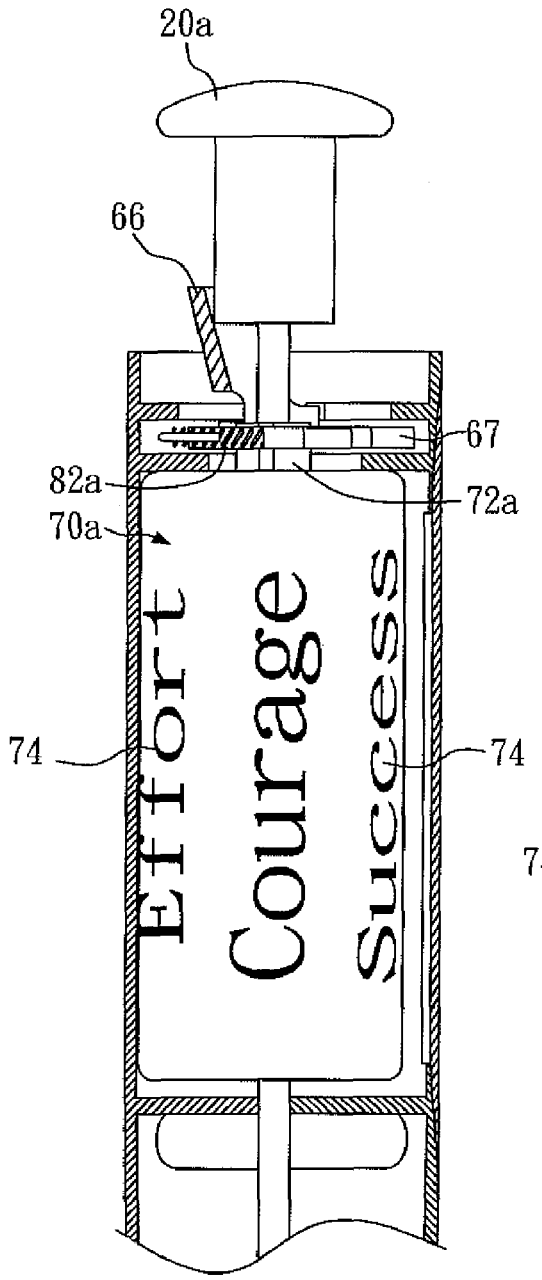
FIG. 9A illustrates a perspective view of the press-action writing instrument when the push button has not been pushed, according to the second embodiment of the present invention.
Figure 10A:
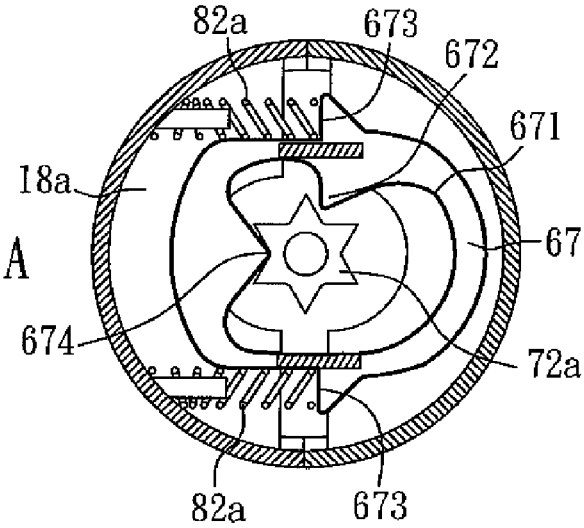
FIG. 10A illustrates a cross-sectional view of the press-action writing instrument when the push button is not pushed, according to the second embodiment of the present invention.

(1) Initial Stage:

Please refer to FIG. 8, FIG. 9A and FIG. 10A. FIG. 9A illustrates a perspective view of the press-action writing instrument 1*a* when the push button 20*a* has not been pushed, according to the second embodiment of the present invention.

Because the push button 20*a* has not yet been pushed, the push button 20*a* has not driven the curved surface 66 of the driving part 60*a* to move.

Figure 9B:
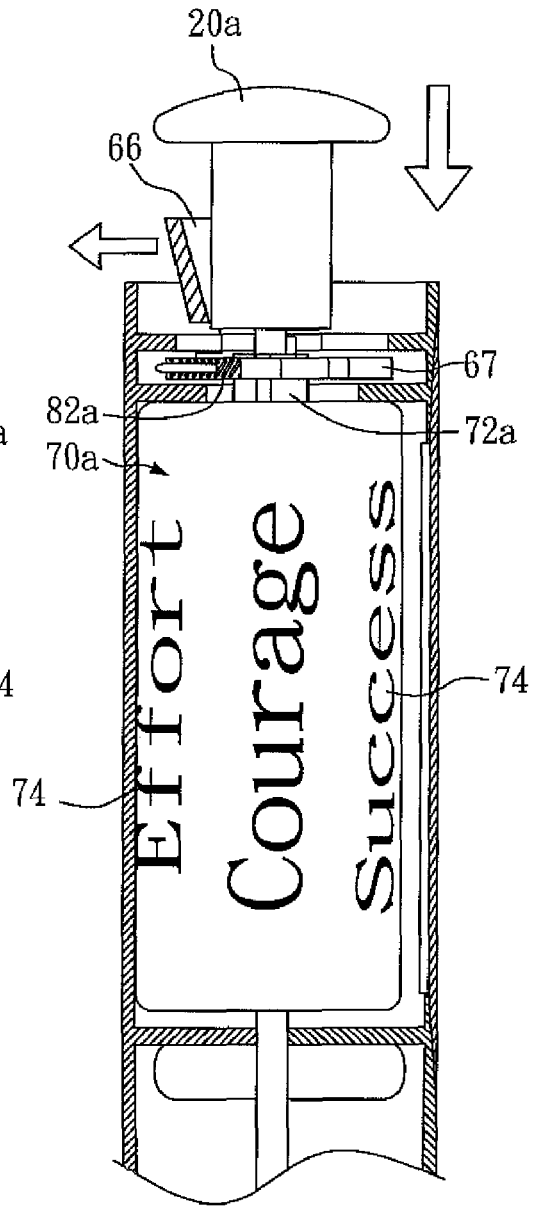
FIG. 9B illustrates a perspective view of the press-action writing instrument when the push button has been pushed, according to the second embodiment of the present invention.
Figure 10B:
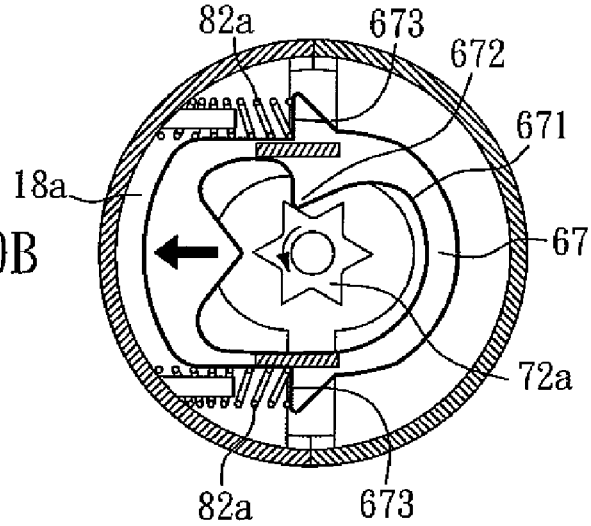
FIG. 10B illustrates a cross-sectional view of the press-action writing instrument when the push button is performing the first stage, according to the second embodiment of the present invention.

(2) First Stage (Driving Stage):

Please refer to FIG. 8, FIG. 9B and FIG. 10B. During the first stage, when the push button 20*a* moves downwards (i.e. moves along the direction of the downward arrow as shown in FIG. 9B), the push button 20*a* drives the curved surface 66 to move along a vertical direction of the holding barrel 10*a* (i.e., to move along the direction of the left arrow as shown in FIG. 9B). Meanwhile, the protrusion 672 of the slice body 67 moves left (i.e., moves along the direction of the left arrow as shown in FIG. 10B) to hit one of the teeth of the following part 72*a*, to drive the rotation barrel 70*a* to rotate.

Figure 10C:
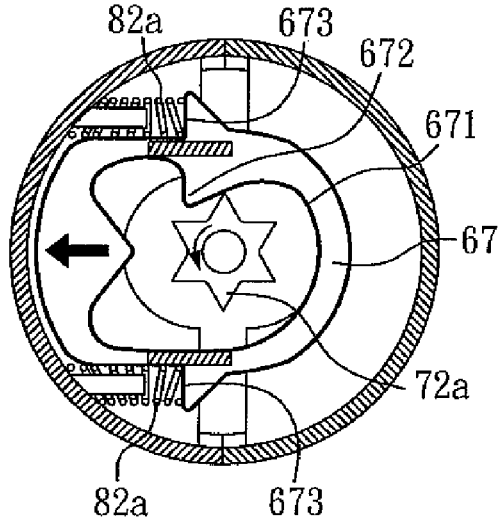
FIG. 10C illustrates a cross-sectional view of the press-action writing instrument when the push button is performing the second stage, according to the second embodiment of the present invention.

(3) Second Stage (Free Rotation Stage):

Please refer to FIG. 8 and FIG. 10C. During the second stage, the slice body 67 keeps moving left (i.e. moving along the direction of the left arrow as shown in FIG. 10C), such that the following part 72*a* departs from the limitation of the protrusion 672. Therefore, and the following part 72*a* can freely rotate according to inertia of the force generated when the user pushes the push button 20*a* to drive the rotation barrel 70*a* to freely rotate.

(4) Third Stage (Positioning Stage):

Please refer to FIG. 8, FIG. 9A and FIG. 10A. During the third stage, the user releases the push button 20a to eliminate the force. Therefore, the driving part 60*a* receives a rebound from the first auxiliary spring 82*a*, such that the slice body 67 can be returned from the position as shown in FIG. 10C to the position as shown in FIG. 10A, and the slice body 67 can position the following part 72*a* via the positioning part 674.

Because the number of the teeth of the following part 72*a* completely matches with the number of the patterns 74, one of the patterns 74 of the rotation barrel 70*a* will face toward the window 16*a*.

Figure 11:
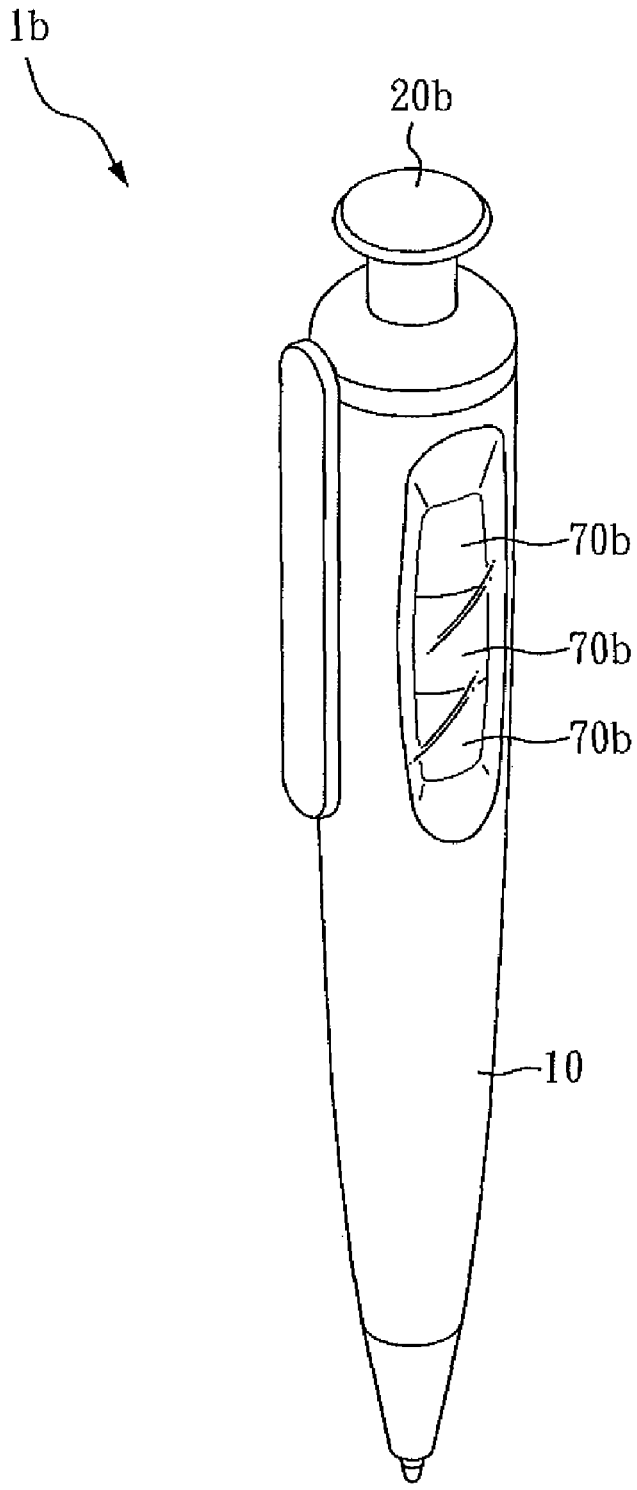
FIG. 11 illustrates a schematic drawing of the press-action writing instrument according to a third embodiment of the present invention.

Please refer to FIG. 11, FIG, 12, FIGS. 12A to 12D, and FIGS. 13A to 13D regarding a press-action device such as a press-action writing instrument 1*b*according to a third embodiment of the present invention. The press-action writing instrument 1*b* of the third embodiment is quite similar to the press-action writing instrument 1 of the first embodiment. The press-action writing instrument 1*b*comprises a holding barrel 10, a push button 20*b*, a writing element 30, a pressing module 40, a rotation module 50*b*, a writing element spring 35, and an auxiliary spring 80*b*. The major difference between the press-action writing instrument 1*b* of the third embodiment and the press-action writing instrument 1 of the first embodiment is the structure of the rotation module 50*b*.

The rotation module 50*b* comprises three rotation barrels 70*b* arranged in tandem. Each rotation barrel 70*b* has a following part 72*b*, and each following part 72*b* has six guiding blocks 76*b*. In fact, the structure of the rotation barrel 70*b* of this embodiment is quite similar to that of the rotation barrel 70 of the first embodiment, but the rotation barrel 70*b* of this embodiment is shorter in length.

The rotation module 50*b* also comprises a driving part 60*b*. The driving part 60*b* also has a rotation shaft receiver 62*b* and a rotation shaft 64*b*. The rotation shaft receiver 62*b* is combined with a clip 11*b*. Similarly, the rotation shaft receiver 62*b* also has a through hole 621*b* and a guiding part 622*b* similar to that of the first embodiment (please refer to FIG. 3B of the first embodiment), such that the rotation shaft 64*b* can rotate downwards and upwards. The rotation shaft 64*b* has three pairs of guiding protrusions 644*b* respectively corresponding to the following part 72*b* of each of the rotation barrels 70*b*.

In the third embodiment, the auxiliary spring 80*b* is placed under the rotation shaft 64*b*. When the push button 20*b* is not pushed, the auxiliary spring 80*b* can push the rotation shaft 64*b* upwards, such that the push button 20*b* can be returned to its top position.

Please refer to FIG. 11, FIG. 12, FIGS. 12A to 12D, and FIGS. 13A to 13D for more details of the implementation, which is also divided into four stages, of the press-action writing instrument 1*b* according to the third embodiment of the present invention.

Figure 12:
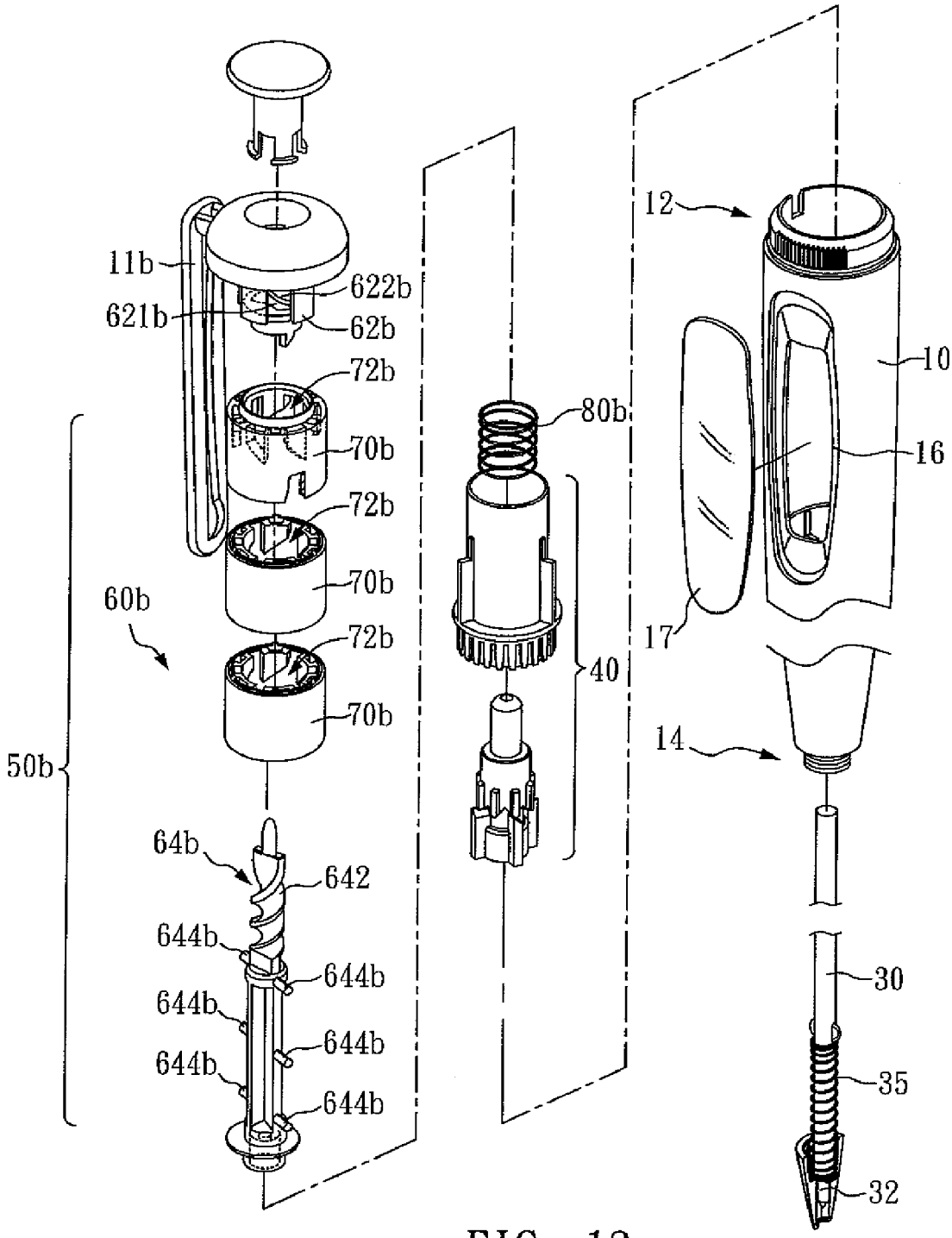
FIG. 12 is an exploded view of the press-action writing instrument according to the third embodiment of the present invention.
Figure 12A:
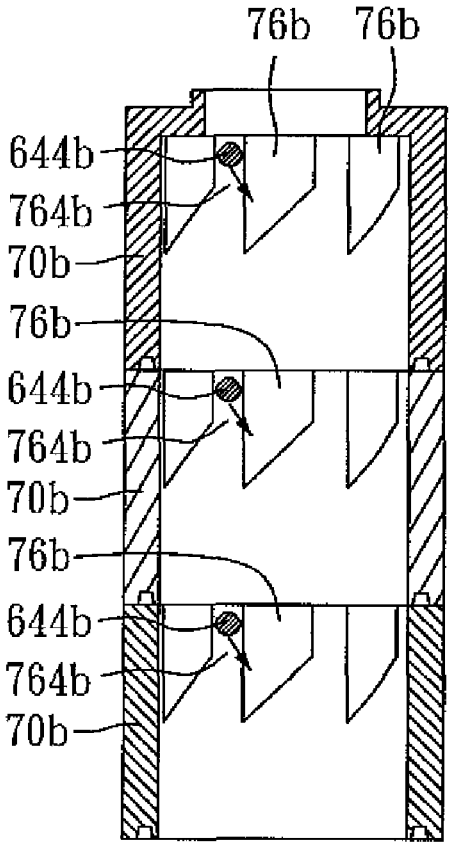
FIGS. 12A to 12D illustrate schematic drawings respectively showing relations among each guiding protrusion of the rotation shaft and guiding blocks of each rotation barrel at different stages according to the third embodiment of the present invention.
Figure 13A:
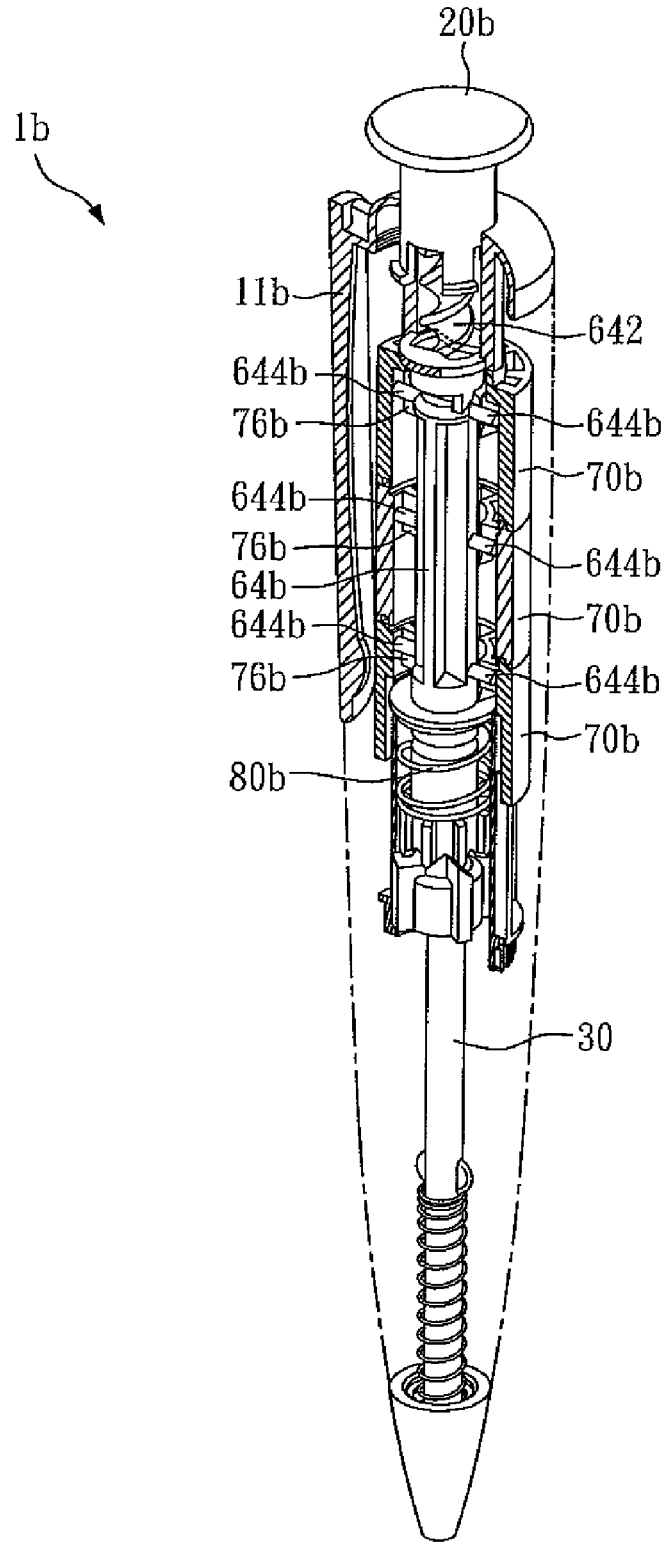
FIGS. 13A to 13D illustrate perspective views, associated with FIGS. 12A to 12D, respectively showing relations between each rotation barrel and the rotation shaft at different stages.

(1) Initial Stage:

Please refer to FIG. 12, FIG. 12A and FIG. 13A. At this time, both the push button 20*b* and the rotation shaft 64*b* are located at the top, and each guiding protrusion 644*b* is located at the upper edge of each guiding groove 764*b*.

Figure 12B:
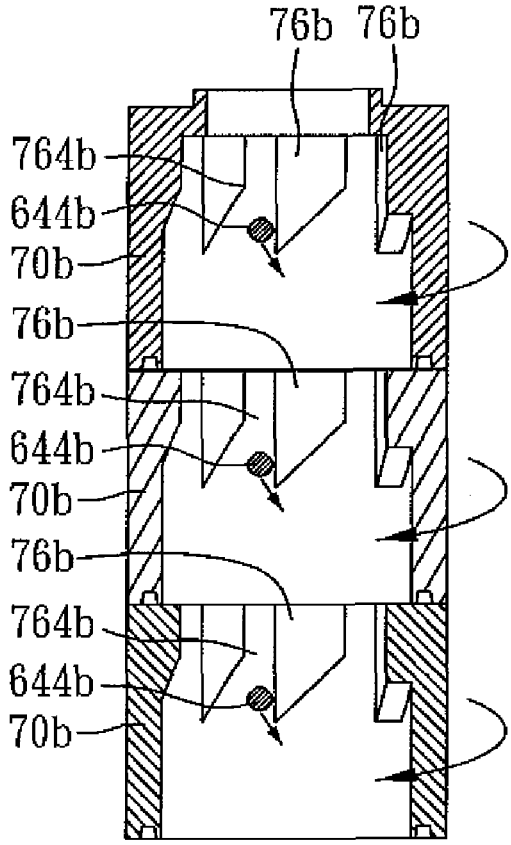
Figure 13B:
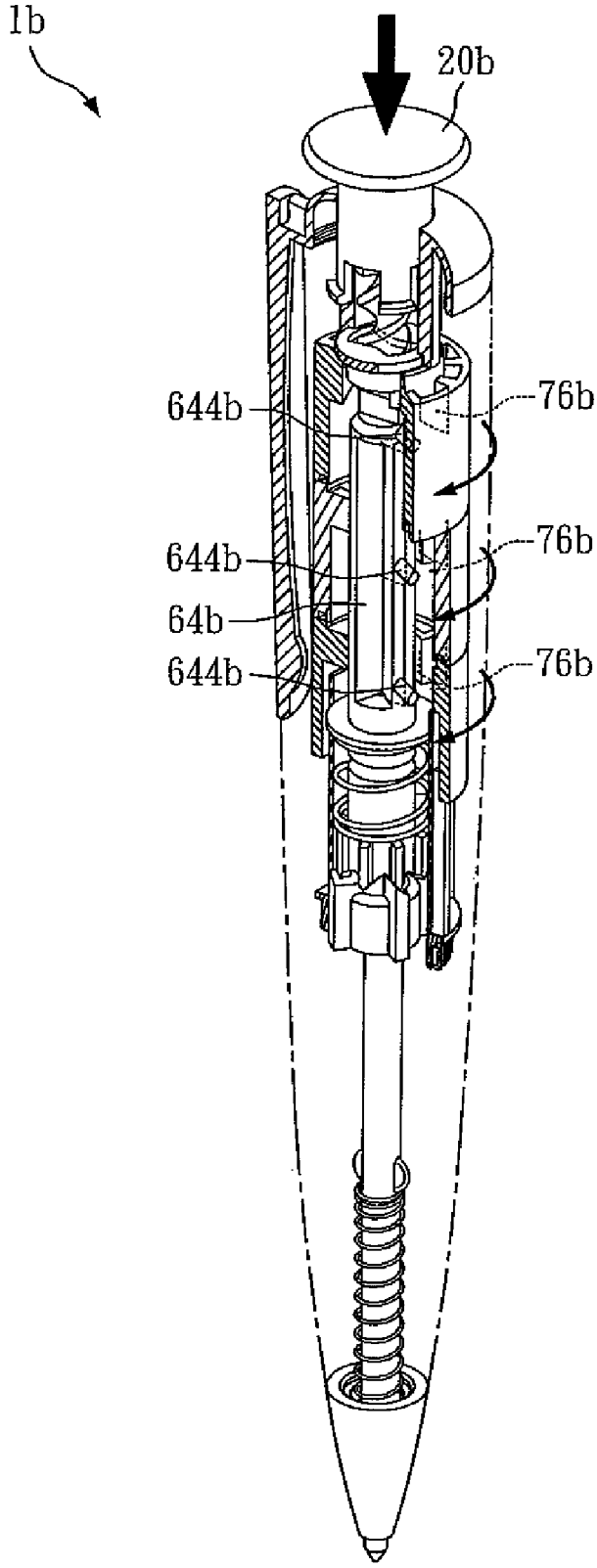
Figure 13C:
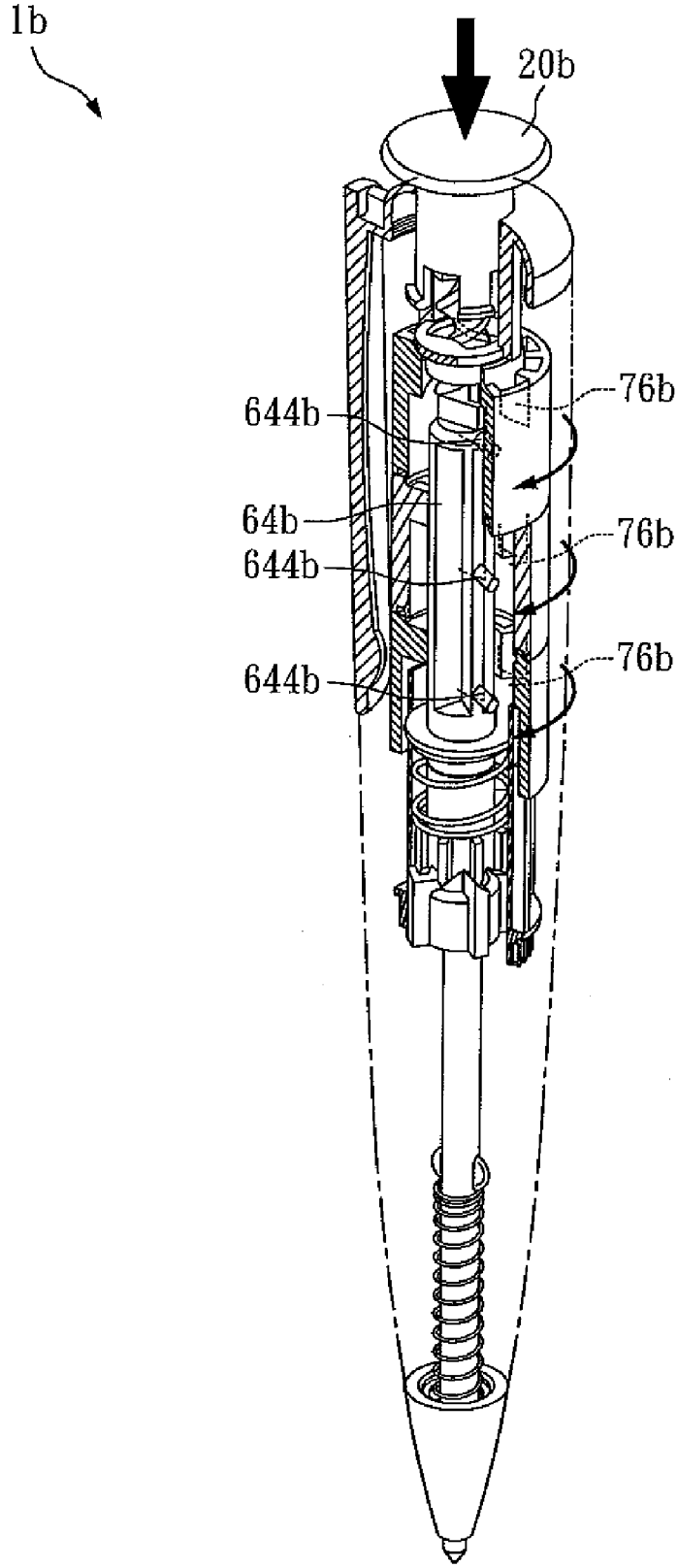

(2) First Stage (Driving Stage):

Please refer to FIG. 12, FIG. 12B and FIG. 13B. When the user pushes the push button 20*b*, the rotation shaft 64*b* moves and rotates downwards (in this embodiment, the rotation shaft 64*b* performs a clockwise rotation), such that the guiding protrusion 644*b* pushes the guiding block 76*b*, to drive each rotation barrel 70*b* to rotate accordingly. Please refer to the description of the first embodiment for more details of the interactions among the components.

Figure 12C:
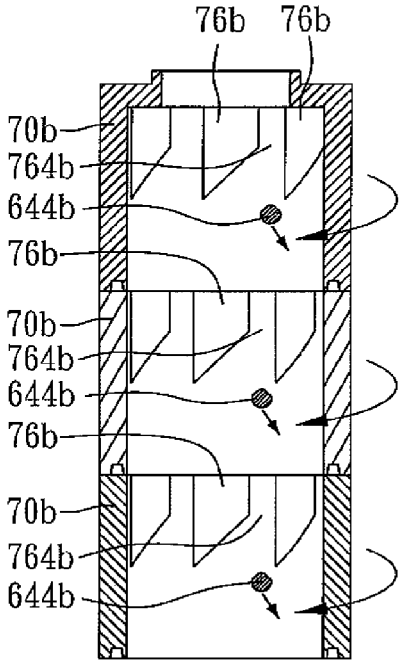

(3) Second Stage (Free Rotation Stage):

Please refer to FIG. 12, FIG. 12C and FIG. 1 SC. When each guiding protrusion 644*b* departs from each guiding groove 764*b*, each rotation barrel 70*b* can freely rotate. Please refer to the description of the first embodiment for more details of the interactions among the components.

Figure 12D:
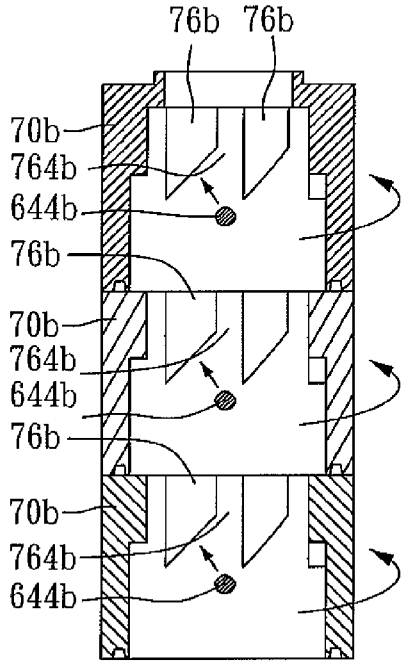
Figure 13D:
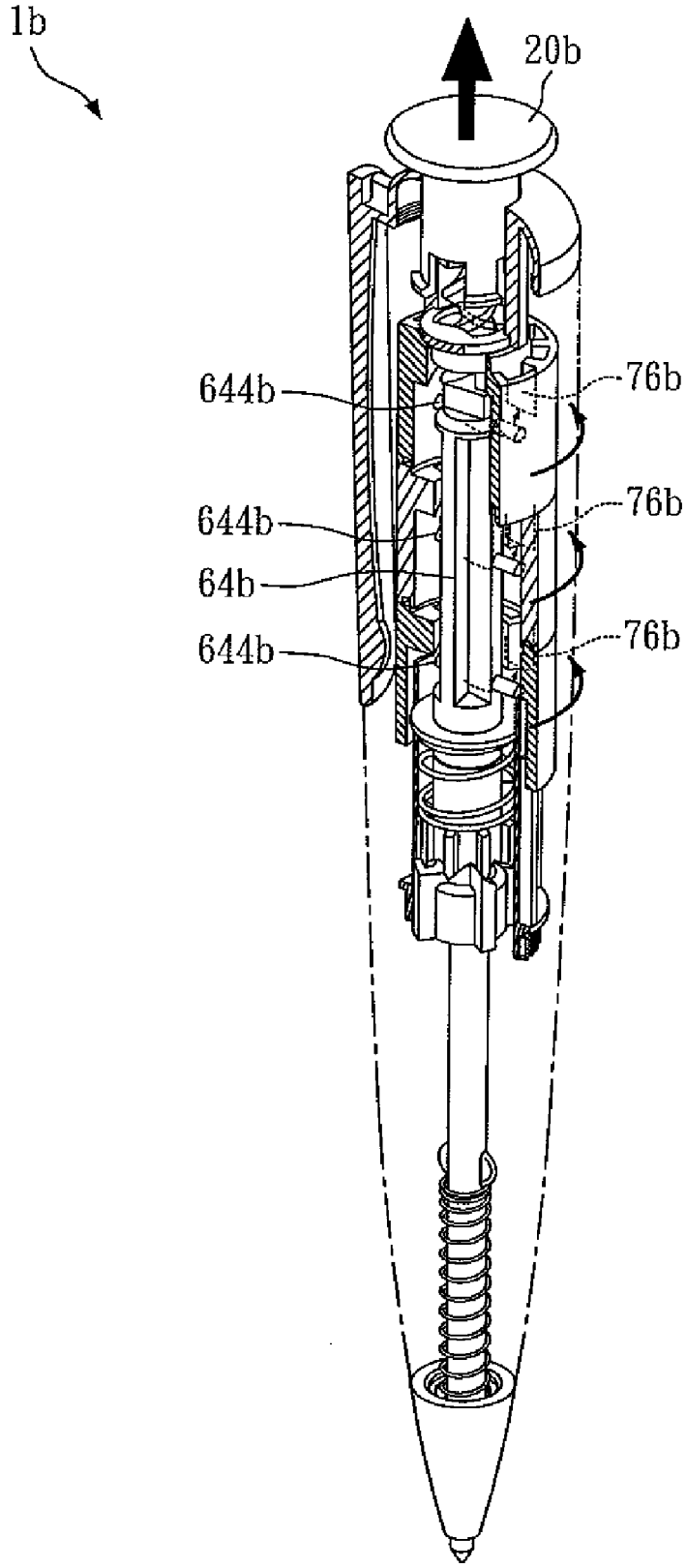

(4) Third Stage (Positioning Stage):

Please refer to FIG. 12, FIG. 12D and FIG. 13D. When the user releases the push button 20*b*, the rotation shaft 64*b* will move upwards according to the rebound from the writing element spring 35 and the auxiliary spring 80*b*. Therefore, each guiding protrusion 644*b* re-enters the each guiding groove 764*b*. Please refer to the description of the first embodiment for more details of the interactions among the components.

Figure 14A:
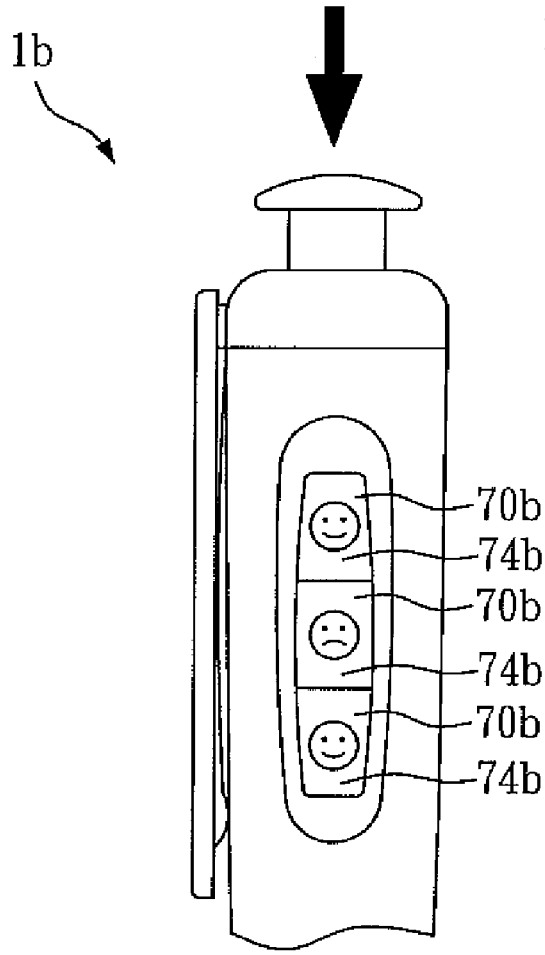
FIG. 14A and FIG. 14B illustrate schematic drawings showing three rotation barrels randomly displaying different patterns in a window according to the third embodiment of the present invention.
Figure 14B:
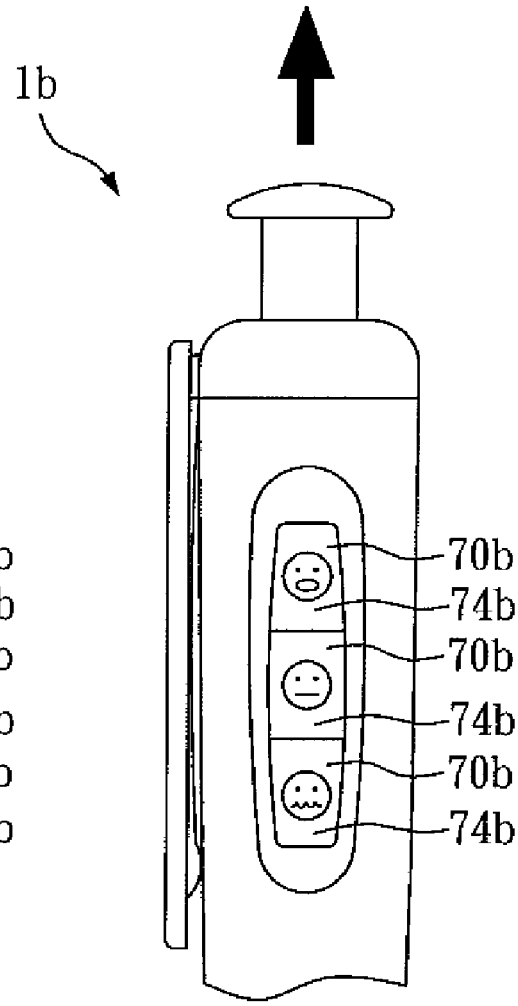

The major difference between the third embodiment and the first embodiment is, in the third embodiment, three rotation barrels 70*b* can respectively rotate every time when the push button 20*b* has been pushed, such that the window 16 can randomly display different patterns 74*b* when these three rotation barrels 70*b* stop, as shown in FIG. 14A and FIG. 14B. Further, because the rotation shaft receiver 62*b* is combined with the clip 11*b*, one component of the press-action writing instrument 1*b* can be eliminated, and the total number of parts is, thus, reduced.

Please note that the number of the rotation barrels 70*b* can be varied. For example, if there are two rotation barrels 70*b*, then the rotation shaft 64*b* has two pairs of guiding protrusions 644*b*accordingly. If there is only one rotation barrel 70*b*, then the rotation shaft 64*b* only needs to have one pair of guiding protrusions 644*b*, which is the same as the implementation of the first embodiment. Furthermore, in order to increase the entertainment value, the press-action writing instrument can be installed with electronic components capable of generating sounds or light so as to provide more amusement when the push button has been pushed.

Figure 15:
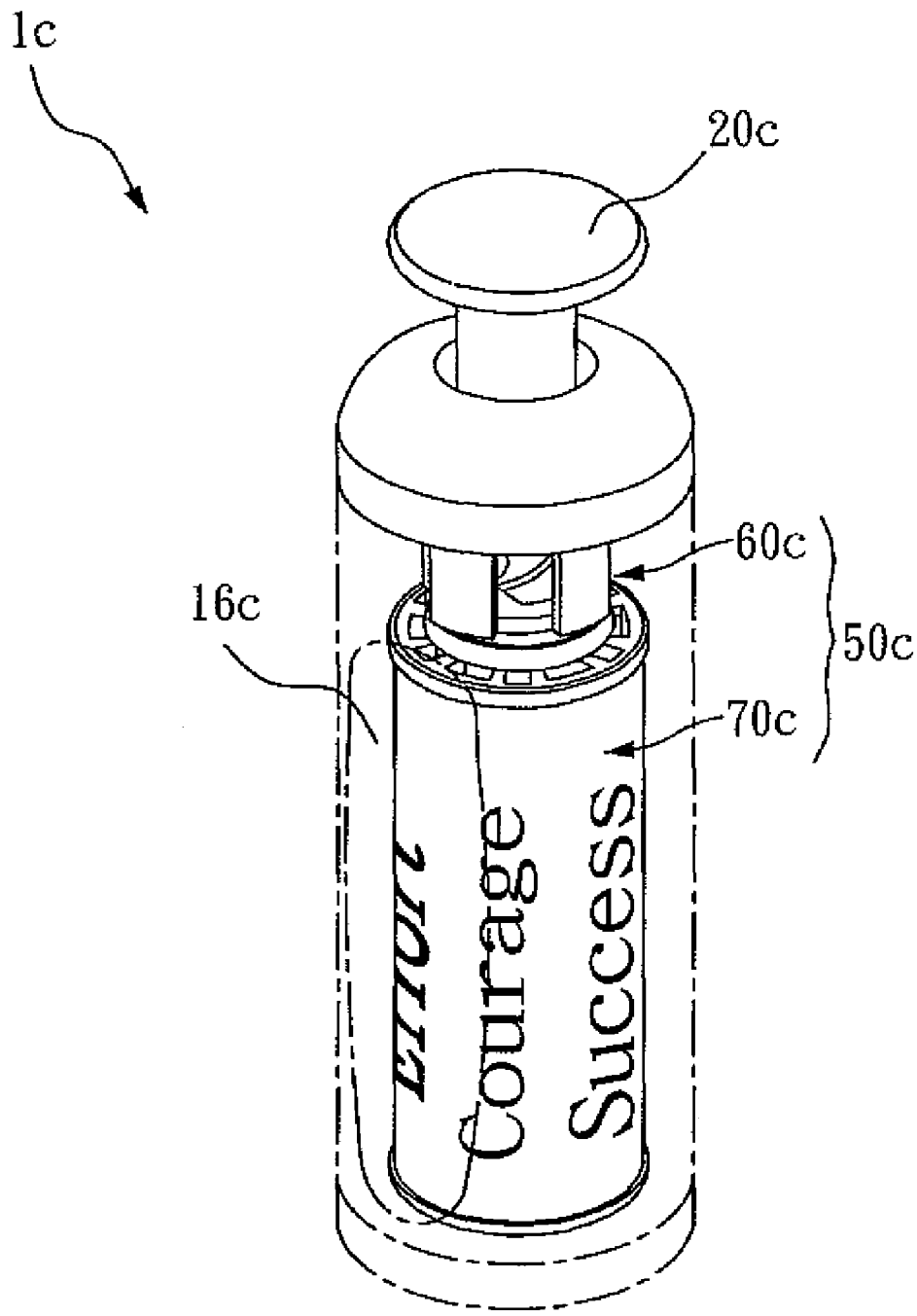
FIG. 15 illustrates a perspective view of a press-action device according to a fourth embodiment of the present invention.
Figure 15A:
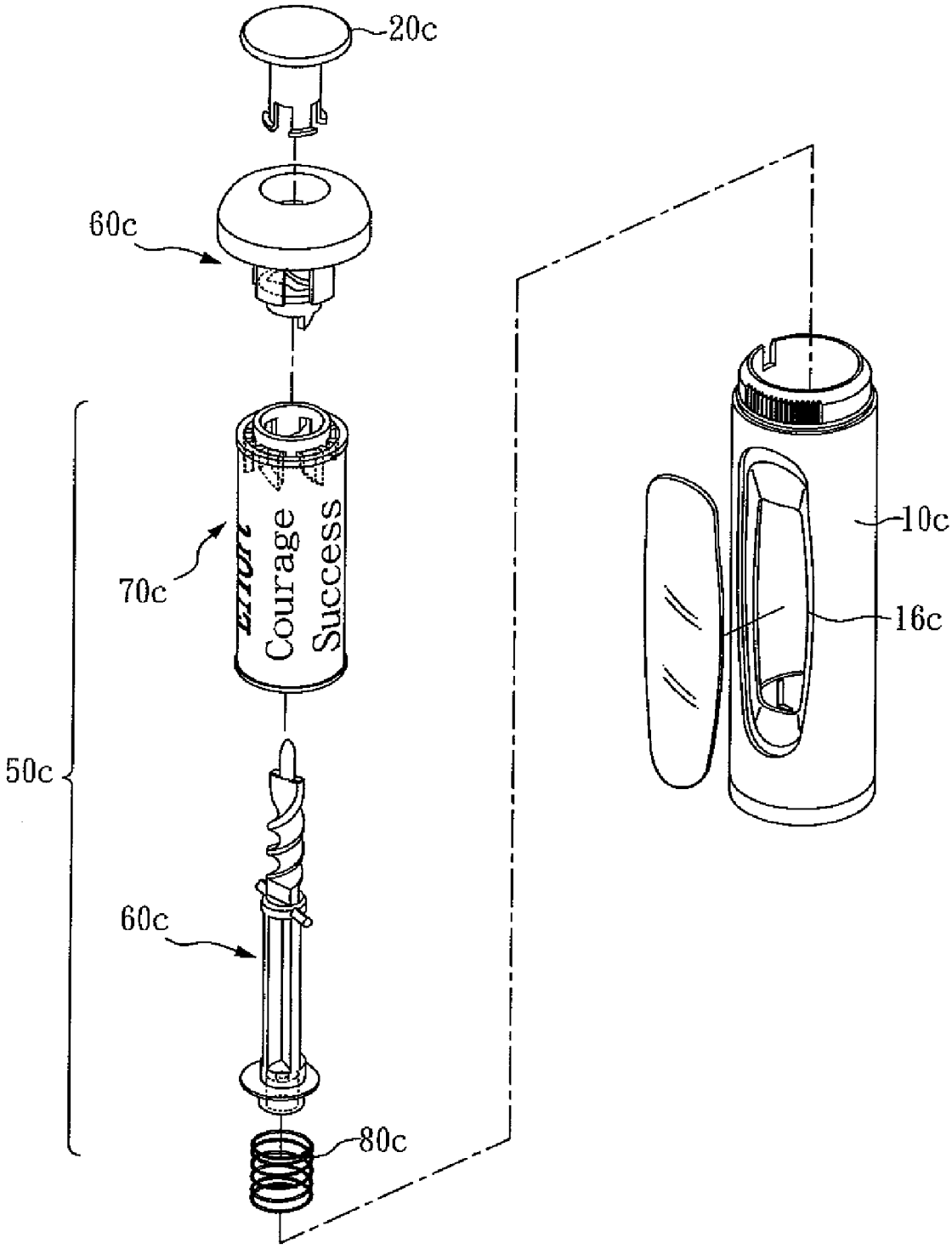
FIG. 15A illustrates an exploded view of a press-action device according to the fourth embodiment of the present invention.

The most novel portion of the present invention is the rotation module 50, which can be installed in a narrow and elongated barrel. Therefore, the rotation module 50 can be installed not only in a writing instrument but also in any elongated object. Please refer to FIG. 15 and FIG. 15A for a press-action device 1*c* according to the fourth embodiment. The press-action device 1*c* comprises a holding barrel 10*c* with the window 16*c*, a push button 20*c*, a rotation module 50*c*, and an auxiliary spring 80*c*. The rotation module 50*c* also comprises a driving part 60*c* and the rotation barrel 70*c*. Please refer the first and the third embodiments for the function of the rotation module 50*c*. Please note that the auxiliary spring 80*c* connected with the rotation module 50*c* is a necessary component for returning the push button 20*c* back to its original position (the third stage mentioned in the above embodiments), since there is no writing element spring 35 like the first and the third embodiments. The press-action device 1*c* can be a toy, an ornament/accessory attached to a key-chain, a necklace, a cell phone, etc.

Figure 16:
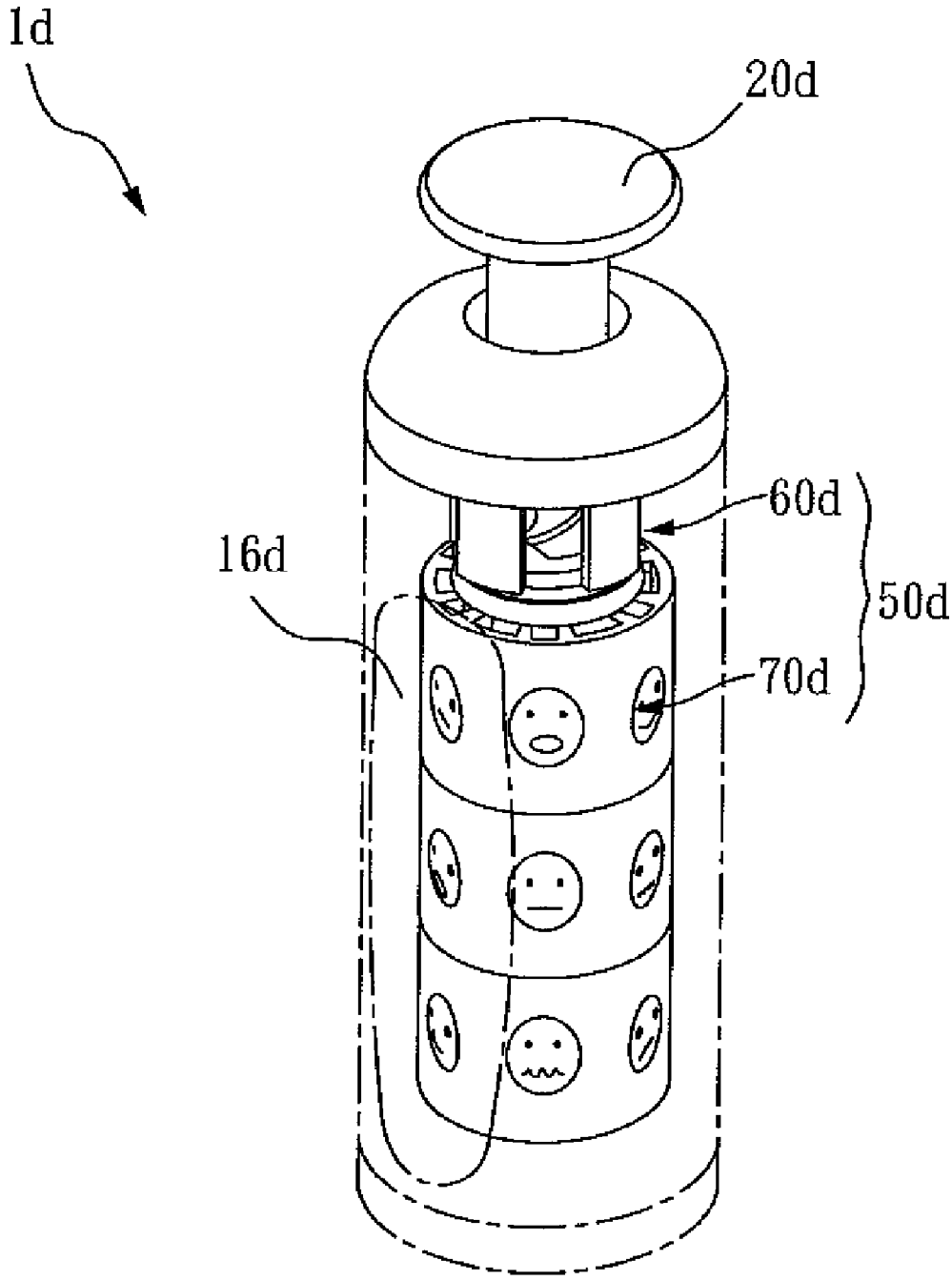
FIG. 16 illustrates a perspective view of a press-action device according to a fifth embodiment of the present invention.
Figure 16A:
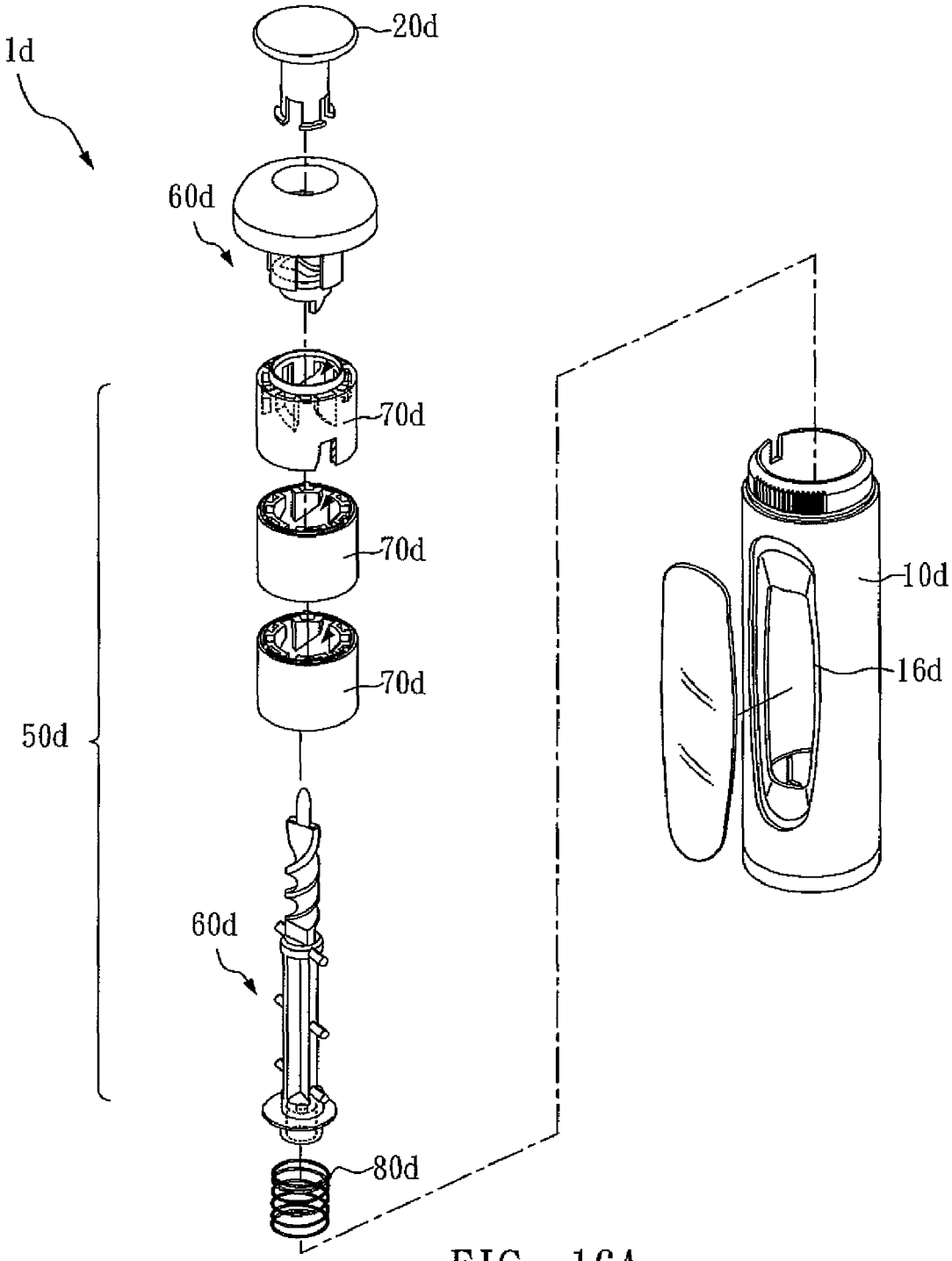
FIG. 16A illustrates an exploded view of a press-action device according to the fifth embodiment of the present invention.

Please refer to FIG. 16 and FIG. 16A for a press-action device 1*d* according to the fifth embodiment. The major difference between the press-action device 1*c* and press-action device 1d is that the rotation module 50*d* comprises three rotation barrels 70*d* arranged in tandem similar to those in the third embodiment, the press-action writing instrument 1*b*. Similarly, the press-action device 1*d* also comprises a holding barrel 10*d* with a window 16*d*, a push button 20*d*, the rotation module 50*d*, and an auxiliary spring 80*d* connected with the rotation module 50*d*. The rotation module 50*d* also comprises a driving part 60*d* and three rotation barrels 70*d* arranged in tandem.

The press-action devices 1*c*, 1*d* also have an initial stage, a first stage, a second stage and a third stage. For details of the components of the rotation module 50*c*, 50*d*, such as the rotation shaft receiver, the rotation shaft, the guiding protrusions, the following part, and the guiding block, please refer to the first and the third embodiments. Since the function of the push button 20*c*, 20*d* and the rotation modules 50*c*, 50*d* have been described in the first and the third embodiments, there is no need to describe the structure in detail.

Although the present invention has been explained in relation to its preferred embodiments, it is to be understood that many other possible modifications and variations can be made without departing from the spirit and scope of the invention as hereinafter claimed. For example, if the press-action writing instruments 1, 1*b* of the present invention do not have the auxiliary spring 80, 80b, then when the writing end 32 of the writing element 30 protrudes from the holding barrel 10, the push button 20, 20b will move only slightly upwards (but not completely return to the top as shown in FIG. 6 and FIG. 13D). Therefore, when the user pushes the push buttons 20, 20b again, the rotation barrels 70, 70*b* can still rotate, but with a slightly worse performance. Furthermore, in the aforementioned embodiments, the windows 16, 16a occupy only a small part of the holding barrels 10, 10*a* but the size of the windows 16,16a can be enlarged as well. For example, the window can completely cover a certain section of the holding barrel. Alternatively, the holding barrel can be made of transparent or translucent materials to turn the entire holding barrel into the window. Please note that there should be at least one transparent or translucent part of the holding barrel so that the patterns printed on the rotation barrel can be seen through the window.

What is claimed is:

1. A press-action writing instrument comprising:

a holding barrel comprising a first end, a second end and a window;

a push button disposed at the first end of the holding barrel, wherein the push button allows a user to propel/repel to perform a linear motion;

a rotation module connected with the push button, with the rotation module comprising:

a driving part connected with the push button; and at least one rotation barrel installed in the holding barrel and located corresponding to the window, wherein the rotation barrel has a following part which can be driven by the driving part;

an auxiliary spring connected with the rotation module;

wherein when the user pushes the push button, the push button firstly performs a first stage, and then performs a second stage;

wherein when the push button is performing the first stage, the driving part drives the following part, to drive the at least one rotation barrel to rotate;

wherein when the push button is performing the second stage, the driving part departs from the following part, to make the at least one rotation barrel freely rotate;

wherein when the user releases the push button, the push button performs a third stage after the second stage;

wherein when the push button is performing the third stage, the driving part holds the following part, to make the at least one rotation barrel stop rotating;

a writing element installed in the holding barrel, wherein the writing element has a writing end;

a pressing module, wherein when the push button is propelled/repelled, the pressing module drives the writing end to protrude from or retract into the second end of the holding barrel; and a writing element spring disposed around the writing element.

2. The press-action writing instrument as claimed in claim 1, wherein the driving part further comprises:

a rotation shaft receiver connected with the first end of the holding barrel, wherein the rotation shaft receiver has a guiding part; and a rotation shaft installed in the rotation shaft receiver and the at least one rotation barrel, wherein the rotation shaft has an external thread, wherein the external thread is associated with the guiding part, and wherein when the rotation shaft is moving upwards/downwards, the rotation shaft rotates accordingly.

3. The press-action writing instrument as claimed in claim 2, wherein the rotation shaft further comprises a guiding protrusion, wherein the following part of the at least one rotation barrel further comprises a plurality of guiding blocks, and wherein when the push button is performing the first stage, the guiding protrusion pushes one of the guiding blocks and the driving part drives the following part.

4. The press-action writing instrument as claimed in claim 3, wherein a guiding groove is formed between each two adjacent guiding blocks, and wherein when the push button is performing the first stage, the guiding protrusion is located in one of the guiding grooves.

5. The press-action writing instrument as claimed in claim 4, wherein when the push button is performing the second stage, the guiding protrusion departs from the one of the guiding grooves.

6. The press-action writing instrument as claimed in claim 1 wherein the at least one rotational barrel comprises a plurality of rotation barrels.

7. The press-action writing instrument as claimed in claim 6, wherein the driving part further comprises:

a rotation shaft receiver connected with the first end of the holding barrel, wherein the rotation shaft receiver has a guiding part; and a rotation shaft installed in the rotation shaft receiver and the plurality of rotation barrels, wherein the rotation shaft has an external thread, wherein the external thread is associated with the guiding part, and wherein when the rotation shaft is moving upwards/downwards, the rotation shaft rotates accordingly.

8. The press-action writing instrument as claimed in claim 7, wherein the rotation shaft further comprises a plurality of guiding protrusions respectively corresponding to each of the plurality of rotation barrels, wherein the following part of the each rotation barrel further comprises a plurality of guiding blocks, wherein when the push button is performing the first stage, the plurality of guiding protrusions push corresponding guiding blocks and the driving part drives the following part.

9. The press-action writing instrument as claimed in claim 8, wherein the rotation shaft receiver further comprises a through hole.

10. A press-action writing instrument comprising:

a holding barrel comprising a first end, a second end and a window;

a push button disposed at the first end of the holding barrel, wherein the push button allows a user to propel/repel to perform a linear motion;

a writing element installed in the holding barrel, wherein the writing element has a writing end;

a pressing module, wherein when the push button is propelled/repelled, the pressing module drives the writing end to protrude from or retract into the second end of the holding barrel;

a rotation module connected with the push button, with the rotating module comprising:

a driving part connected with the push button; and at least one rotation barrel installed in the holding barrel and located corresponding to the window, wherein the rotation barrel has a following part driven by the driving part; and a writing element spring disposed around the writing element;

wherein when the user pushes the push button, the push button firstly performs a first stage, and then performs a second stage, wherein when the push button is performing the first stage, the driving part drives the following part, to drive the at least one rotation barrel to rotate; and wherein when the push button is performing the second stage, the driving part departs from the following part, to make the at least one rotation barrel freely rotate.

11. The press-action writing instrument as claimed in claim 10, wherein when the user releases the push button, the push button performs a third stage after the second stage, wherein:

when the push button is performing the third stage, the driving part holds the following part, to make the at least one rotation barrel stop rotating.

12. The press-action writing instrument as claimed in claim 11, wherein the driving part further comprises:

a rotation shaft receiver connected with the first end of the holding barrel, wherein the rotation shaft receiver has a guiding part; and a rotation shaft installed in the rotation shaft receiver and the at least one rotation barrel, wherein the rotation shaft has an external thread, wherein the external thread is associated with the guiding part, and wherein when the rotation shaft is moving upwards/downwards, the rotation shaft rotates accordingly.

13. The press-action writing instrument as claimed in claim 12 further comprising an auxiliary spring, wherein when the push button is performing the third stage, the auxiliary spring is used for pushing the push button toward the first end of the holding barrel, wherein the rotation shaft further comprises a guiding protrusion, wherein the following part of the at least one rotation barrel further comprises a plurality of guiding blocks, and wherein when the push button is performing the first stage, the guiding protrusion pushes one of the guiding blocks so that the driving part drives the following part.

14. The press-action writing instrument as claimed in claim 13, with the at least one rotation barrel comprising a plurality of rotation barrels, and with the rotation shaft comprising a plurality of guiding protrusions respectively corresponding to each of the plurality of rotation barrels.

15. A press-action device comprising:

a holding barrel comprising a first end, a second end and a window;

a push button disposed at the first end of the holding barrel, wherein the push button allows a user to propel/repel to perform a linear motion;

a rotation module connected with the push button, with the rotation module comprising:

a driving part connected with the push button; and at least one rotation barrel installed in the holding barrel and located corresponding to the window, wherein the rotation barrel has a following part which can be driven by the driving part; and an auxiliary spring connected with the rotation module;

wherein when the user pushes the push button, the push button firstly performs a first stage, and then performs a second stage;

wherein when the push button is performing the first stage, the driving part drives the following part, to drive the at least one rotation barrel to rotate;

wherein when the push button is performing the second stage, the driving part departs from the following part, to make the at least one rotation barrel freely rotate;

wherein when the user releases the push button, the push button performs a third stage after the second stage;

wherein when the push button is performing the third stage, the driving part holds the following part, to make the at least one rotation barrel stop rotating;

wherein the driving part further comprises:

a rotation shaft receiver connected with the first end of the holding barrel, wherein the rotation shaft receiver has a guiding part; and a rotation shaft installed in the rotation shaft receiver and the at least one rotation barrel, wherein the rotation shaft has an external thread, wherein the external thread is associated with the guiding part, and wherein when the rotation shaft is moving upwards/downwards, the rotation shaft rotates accordingly, wherein the rotation shaft further comprises a guiding protrusion, wherein the following part of the at least one rotation barrel further comprises a plurality of guiding blocks, wherein when the push button is performing the first stage, the guiding protrusion pushes one of the guiding blocks and the driving part drives the following part, wherein a guiding groove is formed between each two adjacent guiding blocks, and wherein when the push button is performing the first stage, the guiding protrusion is located in one of the guiding grooves, wherein when the push button is performing the second stage, the guiding protrusion departs from the one of the guiding grooves, wherein each of the guiding blocks is roughly trapezoidal in shape, wherein the guiding block has a long wall, an oblique wall and a short wall, and wherein each of the guiding grooves has a wider lower edge.

16. The press-action device as claimed in claim 15, wherein the rotation shaft receiver further comprises a through hole.

17. The press-action device as claimed in claim 16, wherein the at least one rotation barrel comprises a plurality of rotation barrels, with the rotation shaft comprising a plurality of guiding protrusions respectively corresponding to each of the plurality of rotation barrels.

18. The press-action device as claimed in claim 15, with the press-action device being a press-action writing instrument, and the press-action device further comprising:

a writing element installed in the holding barrel, wherein the writing element has a writing end;

a pressing module, wherein when the push button is propelled/repelled, the pressing module drives the writing end to protrude from or retract into the second end of the holding barrel; and a writing element spring disposed around the writing element.

* * * * *